US007191123B1

(12) United States Patent
Bessette et al.

(10) Patent No.: US 7,191,123 B1
(45) Date of Patent: Mar. 13, 2007

(54) GAIN-SMOOTHING IN WIDEBAND SPEECH AND AUDIO SIGNAL DECODER

(75) Inventors: Bruno Bessette, Rock Forest (CA); Redwan Salami, Ville St-Laurent (CA); Roch Lefebvre, Canton de Magog (CA)

(73) Assignee: Voiceage Corporation, Quebec (CA)

( * ) Notice: Subject to any disclaimer, the term of this patent is extended or adjusted under 35 U.S.C. 154(b) by 645 days.

(21) Appl. No.: 10/129,945

(22) PCT Filed: Nov. 17, 2000

(86) PCT No.: PCT/CA00/01381

§ 371 (c)(1),
(2), (4) Date: Aug. 20, 2002

(87) PCT Pub. No.: WO01/37264

PCT Pub. Date: May 25, 2001

(30) Foreign Application Priority Data

Nov. 18, 1999 (CA) ..... 2290037

(51) Int. Cl.
*G10L 19/14* (2006.01)
*G10L 21/02* (2006.01)
*G10L 11/06* (2006.01)

(52) U.S. Cl. ..... 704/225; 704/224; 704/208; 704/206

(58) Field of Classification Search ..... None
See application file for complete search history.

(56) References Cited

U.S. PATENT DOCUMENTS 5,195,168 A 3/1993 Yong ..... 395/2
5,444,816 A 8/1995 Adoul et al. ..... 395/2.28
5,651,090 A * 7/1997 Moriya et al. ..... 704/200.1
5,664,055 A * 9/1997 Kroon ..... 704/223
5,699,482 A 12/1997 Adoul et al. ..... 395/2.28
5,701,392 A 12/1997 Adoul et al. ..... 395/2.28
5,752,224 A 5/1998 Tsutsui et al. ..... 704/225
5,754,976 A 5/1998 Adoul et al. ..... 704/223
5,953,697 A 9/1999 Lin et al. ..... 704/225
5,960,386 A * 9/1999 Janiszewski et al. ..... 704/207
5,987,406 A * 11/1999 Honkanen et al. ..... 704/220

(Continued)

OTHER PUBLICATIONS

Laflamme, C. Salami, R. Matmti, R. Adoul, J.P. "Harmonic-Stochastic Excitation Speech Coding Below 4kbit/s", Acoustics, Speech and Signal Processing, 1996, vol. 1, pp. 204-207.*

(Continued)

*Primary Examiner*—David Hudspeth
*Assistant Examiner*—Matthew J Sked
(74) *Attorney, Agent, or Firm*—Darby & Darby

(57) ABSTRACT

The gain smoothing method and device modify the amplitude of an innovative codevector in relation to background noise present in a previously sampled wideband signal. The gain smoothing device comprises a gain smoothing calculator for calculating a smoothing gain in response to a factor representative of voicing in the sampled wideband signal, a factor representative of the stability of a set of linear prediction filter coefficients, and an innovative codebook gain. The gain smoothing device also comprises an amplifier for amplifying the innovative codevector with the smoothing gain to thereby produce a gain-smoothed innovative codevector. The function of the gain-smoothing device improves the perceived synthesized signal when background noise is present in the sampled wideband signal.

103 Claims, 5 Drawing Sheets

U.S. PATENT DOCUMENTS

| | | | | |
|---|---|---|---|---|
| 6,260,010 | B1 * | 7/2001 | Gao et al. | 704/230 |
| 6,453,289 | B1 * | 9/2002 | Ertem et al. | 704/225 |
| 6,611,800 | B1 * | 8/2003 | Nishiguchi et al. | 704/221 |

OTHER PUBLICATIONS

Chui, S.P. Chan, C.F. "Low Delay CELP Coding at Bkbps Using Classified Voiced Excitation Codebooks" Speech, Image Processing and Neural Networks, 1994, vol. 2, pp. 472-475.*

Salami, R. Laflamme, C. Adoul, J.P. Kataoka, A. Hayashi, S. Moriya, T. Lamblin, Proust S. Kroon, P. Shoham, Y. "Design and Description of CS-ACELP: A Toll Quality 8 kb/s Speech Coder", Speech and Audio Processing, 1998, vol. 6, issue 2, pp. 116-130.*

Atal, et al., *IEEE Transactions on Acoustics, Speech, and Signal Processing*, ASSP-27:247-254, 1979.

* cited by examiner

GAIN-SMOOTHING IN WIDEBAND SPEECH AND AUDIO SIGNAL DECODER

BACKGROUND OF THE INVENTION

1. Field of the Invention

The present invention relates to a gain-smoothing method and device implemented in a wideband signal encoder.

2. Brief Description of the Prior Art

The demand for efficient digital wideband speech/audio encoding techniques with a good subjective quality/bit rate trade-off is increasing for numerous applications such as audio/video teleconferencing, multimedia, and wireless applications, as well as Internet and packet network applications. Until recently, telephone bandwidths filtered in the range 200–3400 Hz were mainly used in speech encoding applications. However, there is an increasing demand for wideband speech applications in order to increase the intelligibility and naturalness of the speech signals. A bandwidth in the range 50–7000 Hz was found sufficient for delivering a face-to-face speech quality. For audio signals, this range gives an acceptable audio quality, but is still lower than the CD quality which operates in the range 20–20000 Hz.

A speech encoder converts a speech signal into a digital bitstream which is transmitted over a communication channel (or stored in a storage medium). The speech signal is digitized (sampled and quantized usually with 16-bits per sample) and the speech encoder has the role of representing these digital samples with a smaller number of bits while maintaining a good subjective speech quality. The speech decoder or synthesizer processes the transmitted or stored bit stream to convert it back to a sound signal, for example a speech/audio signal.

One of the best prior art techniques capable of achieving a good quality/bit rate trade-off is the so-called Code Excited Linear Prediction (CELP) technique. According to this technique, the sampled speech signal is processed in successive blocks of L samples usually called frames where L is some predetermined number (corresponding to 10–30 ms of speech). In CELP, a linear prediction (LP) synthesis filter is computed and transmitted every frame. The L-sample frame is then divided into smaller blocks called subframes of size N samples, where L=kN and k is the number of subframes in a frame (N usually corresponds to 4–10 ms of speech). An excitation signal is determined in each subframe, which usually consists of two components: one from the past excitation (also called pitch contribution or adaptive codebook) and the other from an innovative codebook (also called fixed codebook). This excitation signal is transmitted and used at the decoder as the input of the LP synthesis filter in order to obtain a synthesized speech.

An innovative codebook in the CELP context, is an indexed set of N-sample-long sequences which will be referred to as N-dimensional codevectors. Each codebook sequence is indexed by an integer k ranging from 1 to M where M represents the size of the codebook often expressed as a number of bits b, where M=2b.

To synthesize speech according to the CELP technique, each block of N samples is synthesized by filtering an appropriate codevector from an innovative codebook through time varying filters modeling the spectral characteristics of the speech signal. At the encoder end, the synthesis output is computed for all, or a subset, of the codevectors from the innovative codebook (codebook search). The retained codevector is the one producing the synthesis output closest to the original speech signal according to a perceptually weighted distortion measure. This perceptual weighting is performed using a so-called perceptual weighting filter, which is usually derived from the LP synthesis filter.

The CELP model has been very successful in encoding telephone band sound signals, and several CELP-based standards exist in a wide range of applications, especially in digital cellular applications. In the telephone band, the sound signal is band-limited to 200–3400 Hz and sampled at 8000 samples/sec. In wideband speech/audio applications, the sound signal is band-limited to 50–7000 Hz and sampled at 16000 samples/sec.

Some difficulties arise when applying the telephone-band optimized CELP model to wideband signals, and additional features need to be added to the model in order to obtain high quality wideband signals. Wideband signals exhibit a much wider dynamic range compared to telephone-band signals, which results in precision problems when a fixed-point implementation of the algorithm is required (which is essential in wireless applications). Furthermore, the CELP model will often spend most of its encoding bits on the low-frequency region, which usually has higher energy contents, resulting in a low-pass output signal.

A problem noted in synthesized speech signals is a reduction in decoder performance when background noise is present in the sampled speech signal. At the decoder end, the CELP model uses post-filtering and post-processing techniques in order to improve the perceived synthesized signal. These techniques need to be adapted to accomodate wideband signals.

SUMMARY OF THE INVENTION

In order to overcome the above discussed problem of the prior art, the present invention provides a method for producing a gain-smoothed codevector during decoding of an encoded signal from a set of signal encoding parameters. The signal contains stationary background noise and the method comprises finding a codevector in relation to at least one first signal encoding parameter of the set, calculating at least one factor representative of stationary background noise in the signal in response to at least one second signal encoding parameter of the set, calculating, in relation to the noise representative factor, a smoothing gain using a non linear operation, and amplifying the found codevector with the smoothing gain to thereby produce the gain-smoothed codevector.

The present invention also relates to a method for producing a gain-smoothed codevector during decoding of an encoded wideband signal from a set of wideband signal encoding parameters, this method comprising:

- finding a codevector in relation to at least one first wideband signal encoding parameter of the set;
- calculating a factor representative of voicing in the wideband signal in response to at least one second wideband signal encoding parameter of the set;
- calculating, in relation to the voicing representative factor, a smoothing gain using a non linear operation; and
- amplifying the found codevector with the smoothing gain to thereby produce the gain-smoothed codevector.

The present invention further relates to a method for producing a gain-smoothed codevector during decoding of an encoded wideband signal from a set of wideband signal encoding parameters. This method comprises finding a codevector in relation to at least one first wideband signal encoding parameter of the set, calculating a factor representative of stability of the wideband signal in response to at least one second wideband signal encoding parameter of the set, calculating, in relation to the stability representative factor, a smoothing gain using a non linear relation, and amplifying the found codevector with the smoothing gain to thereby produce said gain-smoothed codevector.

Still further in accordance with the invention, there is provided a method for producing a gain-smoothed codevector during decoding of an encoded wideband signal from a set of wideband signal encoding parameters, comprising: finding a codevector in relation to at least one first wideband signal encoding parameter of the set; calculating a first factor representative of voicing in the wideband signal in response to at least one second wideband signal encoding parameter of the set; calculating a second factor representative of stability of the wideband signal in response to at least one third wideband signal encoding parameter of the set; calculating a smoothing gain in relation to the first and second factors; and amplifying the found codevector with the smoothing gain to thereby produce the gain-smoothed codevector.

Accordingly, the present invention uses a gain-smoothing feature for efficiently encoding wideband (50–7000 Hz) signals through, in particular but not exclusively, CELP-type encoding techniques, in view of obtaining high a quality reconstructed signal (synthesized signal) especially in the presence of background noise in the sampled wideband signal.

In accordance with preferred embodiments of the gain-smoothed codevector producing method:

finding a codevector comprises finding an innovative codevector in an innovative codebook in relation to said at least one first wideband signal encoding parameter;

the smoothing gain calculation comprises calculating the smoothing gain also in relation to an innovative codebook gain forming a fourth wideband signal encoding parameter of the set;

the first wideband signal encoding parameter comprises an innovative codebook index;

the at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal;

the at least one third wideband signal encoding parameter comprises coefficients of a linear prediction filter calculated during encoding of the wideband signal;

the innovative codevector is found in the innovative codebook in relation to an index k of the innovative codebook, this index k forming the first wideband signal encoding parameter;

calculating a first factor comprises computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k;

the voicing factor rv has a value located between −1 and 1, wherein value 1 corresponds to a pure voiced signal and value −1 corresponds to a pure unvoiced signals;

calculating a smooting gain comprises computing a factor λ using the following relation:

$$\lambda=0.5(1-rv).$$

a factor λ=0 indicates a pure voiced signal and a factor λ=1 indicates a pure unvoiced signal;

calculating a second factor comprises determining a distance measure giving a similarity between adjacent, successive linear prediction filters computed during encoding of the wideband signal;

the wideband signal is sampled prior to encoding, and is processed by frames during encoding and decoding, and determining a distance measure comprises calculating an Immittance Spectral Pair distance measure between the Immitance Spectral Pairs in a present frame n of the wideband signal and the Immittance Spectral Pairs of a past frame n−1 of the wideband signal through the following relation:

$$D_s=\sum_{i=1}^{p-1}(isp_i^{(n)}-isp_i^{(n-1)})^2$$

where p is the order of the linear prediction filter;

calculating a second factor comprises mapping the Immittance Spectral Pair distance measure Ds to the second factor θ through the following relation:

$$\theta=1.25-D_s/400000.0$$

bounded by $0\leqq\theta\leqq1$;

calculating a smoothing gain comprises calculating a gain smoothing factor Sm based on both the first λ and second θ factors through the following relation:

$$S_m=\lambda\theta$$

the factor Sm has a value approaching 1 for an unvoiced and stable wideband signal, and a value approaching 0 for a pure voiced wideband signal or an unstable wideband signal;

calculating a smoothing gain comprises computing an initial modified gain g0 by comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g0 ≦ g − 1 |
| and | | |
| if g ≧ g − 1 then | g0 = g/1.19 | bounded by g0 ≧ g − 1; and |

calculating a smoothing gain comprises determining this smoothing gain through the following relation:

$$g_s=S_m*g_0+(1-S_m)*g.$$

The present invention still further relates:

to implement the above method, a device for producing a gain-smoothed codevector during decoding of an encoded wideband signal from a set of wideband signal encoding parameters; and to a cellular communication system, a cellular network element, a cellular mobile transmitter/receiver unit, and a bidirectional wireless communication sub-system incorporating the above device for producing a gain-smoothed codevector during decoding of the encoded wideband signal from the set of wideband signal encoding parameters.

The above and other objects, advantages and features of the present invention will become more apparent upon reading the following non restrictive description of a preferred embodiment thereof, given for the purpose of illustration only with reference to the accompanying drawings.

DETAILED DESCRIPTION OF THE PREFERRED EMBODIMENT

Figure 4:
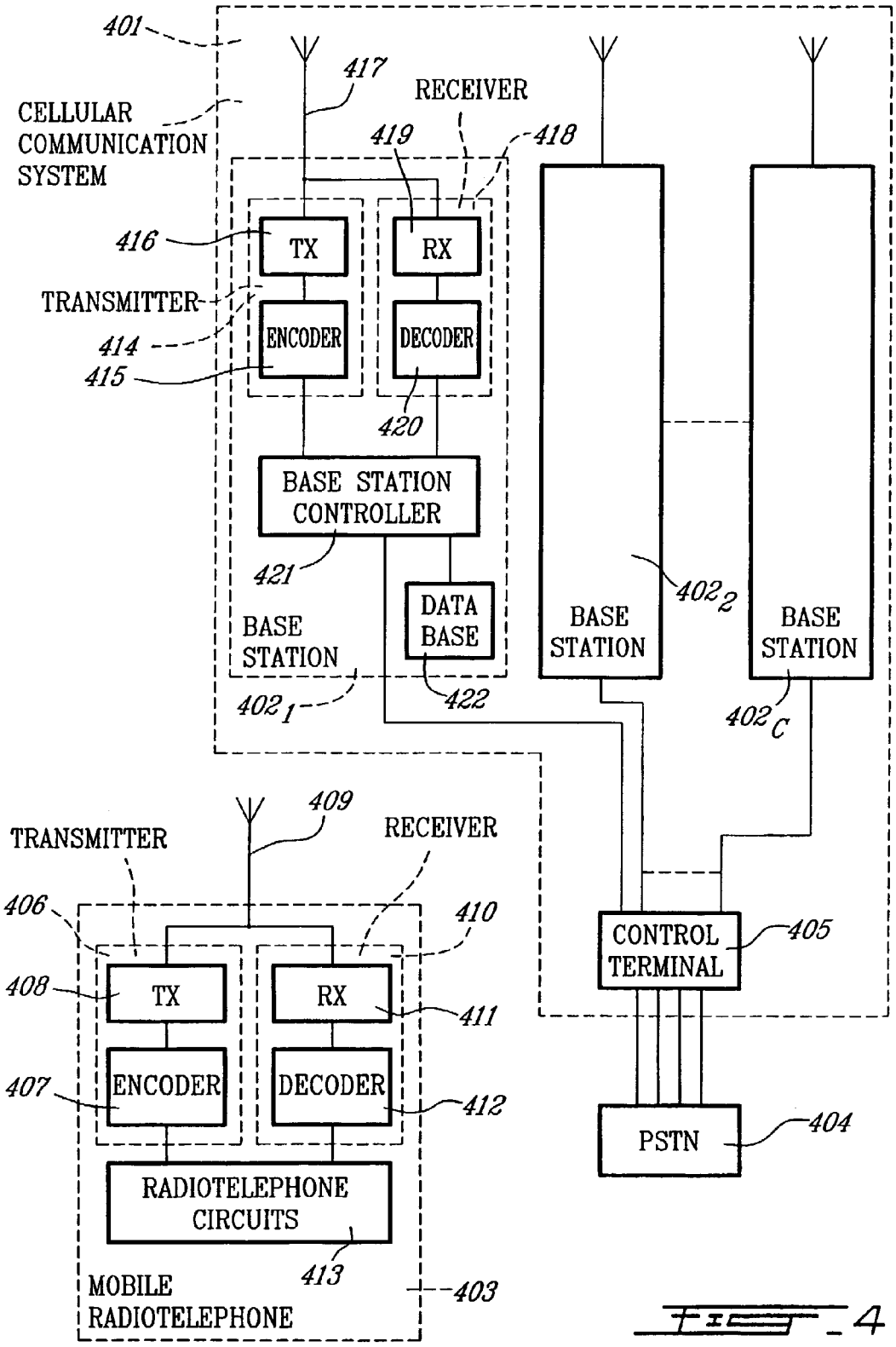
FIG. 4 is a schematic flow chart of the gain-smoothing method embodied in the wideband decoder of FIG. 2.

As well known to those of ordinary skill in the art, a cellular communication system such as 401 (see FIG. 4) provides a telecommunication service over a large geographic area by dividing that large geographic area into a number C of smaller cells. The C smaller cells are serviced by respective cellular base stations 4021, 4022 . . . 402C to provide each cell with radio signaling, audio and data channels.

Radio signaling channels are used to page mobile radiotelephones (mobile transmitter/receiver units) such as 403 within the limits of the coverage area (cell) of the cellular base station 402, and to place calls to other radiotelephones 403 located either inside or outside the base station's cell or to another network such as the Public Switched Telephone Network (PSTN) 404.

Once a radiotelephone 403 has successfully placed or received a call, an audio or data channel is established between this radiotelephone 403 and the cellular base station 402 corresponding to the cell in which the radiotelephone 403 is situated, and communication between the base station 402 and radiotelephone 403 is conducted over that audio or data channel. The radiotelephone 403 may also receive control or timing information over a signaling channel while a call is in progress.

If a radiotelephone 403 leaves a cell and enters another adjacent cell while a call is in progress, the radiotelephone 403 hands over the call to an available audio or data channel of the base station 402 of the new cell. If a radiotelephone 403 leaves a cell and enters another adjacent cell while no call is in progress, the radiotelephone 403 sends a control message over the signaling channel to log into the base station 402 of the new cell. In this manner mobile communication over a wide geographical area is possible.

The cellular communication system 401 further comprises a control terminal 405 to control communication between the cellular base stations 402 and the PSTN 404, for example during a communication between a radiotelephone 403 and the PSTN 404, or between a radiotelephone 403 located in a first cell and a radiotelephone 403 situated in a second cell.

Of course, a bidirectional wireless radio communication subsystem is required to establish an audio or data channel between a base station 402 of one cell and a radiotelephone 403 located in that cell. As illustrated in very simplified form in FIG. 4, such a bidirectional wireless radio communication subsystem typically comprises in the radiotelephone 403:

- a transmitter 406 including:
  - an encoder 407 for encoding speech; and
  - a transmission circuit 408 for transmitting the encoded speech from the encoder 407 through an antenna such as 409; and
- a receiver 410 including:
  - a receiving circuit 411 for receiving transmitted encoded speech usually through the same antenna 409; and
  - a decoder 412 for decoding the received encoded speech from the receiving circuit 411.

The radiotelephone 403 further comprises other conventional radiotelephone circuits 413 to which the encoder 407 and decoder 412 are connected and for processing signals therefrom, which circuits 413 are well known to those of ordinary skill in the art and, accordingly, will not be further described in the present specification.

Also, such a bidirectional wireless radio communication subsystem typically comprises in each base station 402:

- a transmitter 414 including:
  - an encoder 415 for encoding speech; and
  - a transmission circuit 416 for transmitting the encoded speech from the encoder 415 through an antenna such as 417; and
- a receiver 418 including:
  - a receiving circuit 419 for receiving transmitted encoded speech through the same antenna 417 or through another antenna (not shown); and
  - a decoder 420 for decoding the received encoded speech from the receiving circuit 419.

The base station 402 further comprises, typically, a base station controller 421, along with its associated database 422, for controlling communication between the control terminal 405 and the transmitter 414 and receiver 418.

As well known to those of ordinary skill in the art, voice encoding is required in order to reduce the bandwidth necessary to transmit sound signals, for example voice signal such as speech, across the bidirectional wireless radio communication subsystem, i.e., between a radiotelephone 403 and a base station 402.

LP voice encoders (such as 415 and 407) typically operating at 13 kbits/second and below such as Code-Excited Linear Prediction (CELP) encoders typically use a LP synthesis filter to model the short-term spectral envelope of speech. The LP information is transmitted, typically, every 10 or 20 ms to the decoder (such 420 and 412) and is extracted at the decoder end.

The novel techniques disclosed in the present specification can apply to different LP-based encoders. However, a CELP-type encoder is used in the preferred embodiment for the purpose of presenting a non-limitative illustration of these techniques. In the same manner, such techniques can be used with sound signals other than speech and voice as well as with other types of wideband signals.

Figure 1:
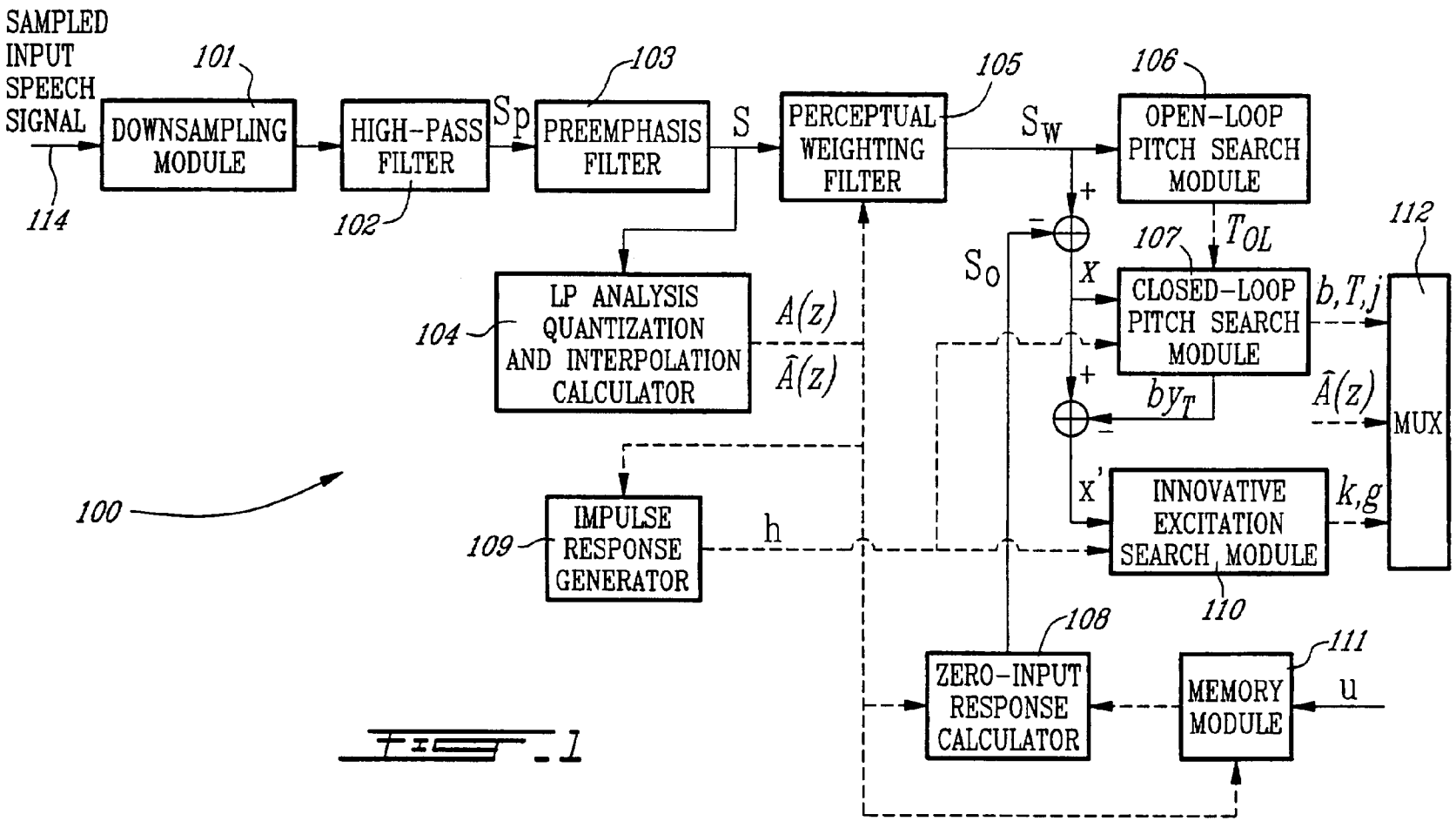
FIG. 1 is a schematic block diagram of a wideband encoder.

FIG. 1 shows a general block diagram of a CELP-type speech encoder 100 modified to better accommodate wideband signals.

The sampled input speech signal 114 is divided into successive L-sample blocks called "frames". During each frame, different parameters representing the speech signal in the frame are computed, encoded, and transmitted. LP parameters representing the LP synthesis filter are usually computed once every frame. The frame is further divided into smaller blocks of N samples (blocks of length N), in which excitation parameters (pitch and innovation) are determined. In the CELP literature, these blocks of length N are called "subframes" and the N-sample signals in the subframes are referred to as N-dimensional vectors. In this preferred embodiment, the length N corresponds to 5 ms while the length L corresponds to 20 ms, which means that a frame contains four subframes (N=80 at the sampling rate of 16 kHz and 64 after down-sampling to 12.8 kHz). Various N-dimensional vectors are involved in the encoding procedure. A list of vectors appearing in FIGS. 1 and 2 as well as a list of transmitted parameters are given herein below:

List of the Main N-Dimensional Vectors s Wideband signal input speech vector (after down-sampling, pre-processing, and preemphasis);

sw Weighted speech vector;

s0 Zero-input response of weighted synthesis filter;

sp Down-sampled pre-processed signal;
Oversampled synthesized speech signal;

s' Synthesis signal before deemphasis;

sd Deemphasized synthesis signal;

sh Synthesis signal after deemphasis and postprocessing;

x Target vector for pitch search;

x' Target vector for innovative search;

h Weighted synthesis filter impulse response;

vT Adaptive (pitch) codebook vector at delay T;

yT Filtered pitch codebook vector (vT convolved with h);

ck Innovative codevector at index k (k-th entry from the innovative codebook);

cf Enhanced scaled innovative codevector;

u Excitation signal (scaled innovative and pitch codevectors);

u' Enhanced excitation;

z Band-pass noise sequence;

w' White noise sequence; and w Scaled noise sequence.

List of Transmitted Parameters

STP Short term prediction parameters (defining A(z));

T Pitch lag (or pitch codebook index);

b Pitch gain (or pitch codebook gain);

j Index of the low-pass filter applied to the pitch codevector;

k Codevector index (innovative codebook entry); and g Innovative codebook gain.

In this preferred embodiment, the STP parameters are transmitted once per frame and the rest of the parameters are transmitted four times per frame (every subframe).

ENCODER 100

The sampled speech signal is encoded on a block by block basis by the encoder 100 of FIG. 1 which is broken down into eleven (11) modules bearing references 101 to 111, respectively.

The input speech is processed into the above mentioned L-sample blocks called frames.

Referring to FIG. 1, the sampled input speech signal 114 is down-sampled in a down-sampling module 101. For example, the signal is down-sampled from 16 kHz down to 12.8 kHz, using techniques well known to those of ordinary skill in the art. Down-sampling to a frequency other than 12.8 kHz can of course be envisaged. Down-sampling increases the coding efficiency, since a smaller frequency bandwidth is encoded. This also reduces the algorithmic complexity since the number of samples in a frame is decreased. The use of down-sampling becomes significant when the bit rate is reduced below 16 kbit/sec, although down-sampling is not essential above 16 kbit/sec.

After down-sampling, the 320-sample frame of 20 ms is reduced to a 256-sample frame (down-sampling ratio of 4/5).

The input frame is then supplied to the optional pre-processing block 102. Pre-processing block 102 may consist of a high-pass filter with a 50 Hz cut-off frequency. High-pass filter 102 removes the unwanted sound components below 50 Hz.

The down-sampled pre-processed signal is denoted by sp(n), n=0, 1, 2, . . . ,L−1, where L is the length of the frame (256 at a sampling frequency of 12.8 kHz). In a preferred embodiment of the preemphasis filter 103, the signal sp(n) is preemphasized using the following transfer function:

$$P(z)=1-\mu z^{-1}$$

where μ is a preemphasis factor with a value located between 0 and 1 (a typical value is μ=0.7). A higher-order filter could also be used. It should be pointed out that high-pass filter 102 and preemphasis filter 103 can be interchanged to obtain more efficient fixed-point implementations.

The function of the preemphasis filter 103 is to enhance the high frequency contents of the input signal. It also reduces the dynamic range of the input speech signal, which renders it more suitable for fixed-point implementation. Without preemphasis, LP analysis in fixed-point using single-precision arithmetic is difficult to implement.

Preemphasis also plays an important role in achieving a proper overall perceptual weighting of the quantization error, which contributes to improve sound quality. This will be explained in more detail herein below.

The output of the preemphasis filter 103 is denoted s(n). This signal is used for performing LP analysis in calculator module 104. LP analysis is a technique well known to those of ordinary skill in the art. In this preferred embodiment, the autocorrelation approach is used. In the autocorrelation approach, the signal s(n) is first windowed using a Hamming window (having usually a length of the order of 30–40 ms). The autocorrelations are computed from the windowed signal, and Levinson-Durbin recursion is used to compute LP filter coefficients, ai, where i=1, . . . ,p, and where p is the LP order, which is typically 16 in wideband coding. The parameters ai are the coefficients of the transfer function of the LP filter, which is given by the following relation:

$$A(z) = 1 + \sum_{i=1}^{p} a_i z^{-1}$$

LP analysis is performed in calculator module 104, which also performs the quantization and interpolation of the LP filter coefficients. The LP filter coefficients are first transformed into another equivalent domain more suitable for quantization and interpolation purposes. The line spectral pair (LSP) and immitance spectral pair (ISP) domains are two domains in which quantization and interpolation can be efficiently performed. The 16 LP filter coefficients, ai, can be quantized in the order of 30 to 50 bits using split or multi-stage quantization, or a combination thereof. The purpose of the interpolation is to enable updating the LP filter coefficients every subframe while transmitting them once every frame, which improves the encoder performance without increasing the bit rate. Quantization and interpolation of the LP filter coefficients is believed to be otherwise well known to those of ordinary skill in the art and, accordingly, will not be further described in the present specification.

The following paragraphs will describe the rest of the coding operations performed on a subframe basis. In the following description, the filter A(z) denotes the unquantized interpolated LP filter of the subframe, and the filter $\hat{A}(z)$ denotes the quantized interpolated LP filter of the subframe.

Perceptual Weighting:

In analysis-by-synthesis encoders, the optimum pitch and innovative parameters are searched by minimizing the mean squared error between the input speech and synthesized speech in a perceptually weighted domain. This is equivalent to minimizing the error between the weighted input speech and weighted synthesis speech.

The weighted signal sw(n) is computed in a perceptual weighting filter 105. Traditionally, the weighted signal sw(n) has been computed by a weighting filter having a transfer function W(z) in the form:

$$W(z)=A(z/\gamma_1)/A(z/\gamma_2)$$

where $$0<\gamma_2<\gamma_1\leqq 1$$

As well known to those of ordinary skill in the art, in prior art analysis-by-synthesis (AbS) encoders, analysis shows that the quantization error is weighted by a transfer function W−1(z), which is the inverse of the transfer function of the perceptual weighting filter 105. This result is well described by B. S. Atal and M. R. Schroeder in "Predictive coding of speech and subjective error criteria", IEEE Transaction ASSP, vol. 27, no. 3, pp. 247–254, June 1979. Transfer function W−1(z) exhibits some of the formant structure of the input speech signal. Thus, the masking property of the human ear is exploited by shaping the quantization error so that it has more energy in the formant regions where it will be masked by the strong signal energy present in these regions. The amount of weighting is controlled by the factors y1 and y2.

The above traditional perceptual weighting filter 105 works well with telephone band signals. However, it was found that this traditional perceptual weighting filter 105 is not suitable for efficient perceptual weighting of wideband signals. It was also found that the traditional perceptual weighting filter 105 has inherent limitations in modelling the formant structure and the required spectral tilt concurrently. The spectral tilt is more pronounced in wideband signals due to the wide dynamic range between low and high frequencies. The prior art has suggested to add a tilt filter into W(z) in order to control the tilt and formant weighting of the wideband input signal separately.

A novel solution to this problem is to introduce the preemphasis filter 103 at the input, compute the LP filter A(z) based on the preemphasized speech s(n), and use a modified filter W(z) by fixing its denominator.

LP analysis is performed in module 104 on the preemphasized signal s(n) to obtain the LP filter A(z). Also, a new perceptual weighting filter 105 with fixed denominator is used. An example of transfer function for the perceptual weighting filter 105 is given by the following relation:

$$0<\gamma_2<\gamma_1\leqq 1$$

$$W(z)=A(z/\gamma_1)/(1-\gamma_2 z^{-1})$$

where

A higher order can be used at the denominator. This structure substantially decouples the formant weighting from the tilt.

Note that because A(z) is computed based on the preemphasized speech signal s(n), the tilt of the filter 1/A(z/γ1) is less pronounced compared to the case when A(z) is computed based on the original speech. Since deemphasis is performed at the decoder end using a filter having the transfer function:

$$P^{-1}(z) = 1/(1-\mu_z^{-1}),$$

the quantization error spectrum is shaped by a filter having a transfer function W−1(z)P−1(z). When γ2 is set equal to μ, which is typically the case, the spectrum of the quantization error is shaped by a filter whose transfer function is 1/A(z/γ1), with A(z) computed based on the preemphasized speech signal. Subjective listening showed that this structure for achieving the error shaping by a combination of preemphasis and modified weighting filtering is very efficient for encoding wideband signals, in addition to the advantages of ease of fixed-point algorithmic implementation.

Pitch Analysis:

In order to simplify the pitch analysis, an open-loop pitch lag TOL is first estimated in the open-loop pitch search module 106 using the weighted speech signal sw(n). Then the closed-loop pitch analysis, which is performed in closed-loop pitch search module 107 on a subframe basis, is restricted around the open-loop pitch lag TOL which significantly reduces the search complexity of the LTP parameters T and b (pitch lag and pitch gain, respectively). Open-loop pitch analysis is usually performed in module 106 once every 10 ms (two subframes) using techniques well known to those of ordinary skill in the art.

The target vector x for LTP (Long Term Prediction) analysis is first computed. This is usually done by subtracting the zero-input response s0 of weighted synthesis filter $W(z)/\hat{A}(z)$ from the weighted speech signal sw(n). This zero-input response s0 is calculated by a zero-input response calculator 108. More specifically, the target vector x is calculated using the following relation:

$$x=s_w-s_0$$

where x is the N-dimensional target vector, sw is the weighted speech vector in the subframe, and s0 is the zero-input response of filter $W(z)/\hat{A}(z)$ which is the output of the combined filter $W(z)/\hat{A}(z)$ due to its initial states. The zero-input response calculator 108 is responsive to the quantized interpolated LP filter $\hat{A}(z)$ from the LP analysis, quantization and interpolation calculator module 104 and to the initial states of the weighted synthesis filter $W(z)/\hat{A}(z)$ stored in memory module 111 to calculate the zero-input response s0 (that part of the response due to the initial states as determined by setting the inputs equal to zero) of filter W(z)/Â(z). Again, this operation is well known to those of ordinary skill in the art and, accordingly, will not be further described.

Of course, alternative but mathematically equivalent approaches can be used to compute the target vector x.

A N-dimensional impulse response vector h of the weighted synthesis filter W(z)/Â(z) is computed in the impulse response generator module 109 using the LP filter coefficients A(z) and Â(z) from module 104. Again, this operation is well known to those of ordinary skill in the art and, accordingly, will not be further described in the present specification.

The closed-loop pitch (or pitch codebook) parameters b, T and j are computed in the closed-loop pitch search module 107, which uses the target vector x, the impulse response vector h and the open-loop pitch lag TOL as inputs. Traditionally, the pitch prediction has been represented by a pitch filter having the following transfer function:

$$1/(1-bz^{-T})$$

where b is the pitch gain and T is the pitch delay or lag. In this case, the pitch contribution to the excitation signal u(n) is given by bu(n−T), where the total excitation is given by $$u(n)=bu(n-T)+gc_k(n)$$

with g being the innovative codebook gain and ck(n) the innovative codevector at index k.

This representation has limitations if the pitch lag T is shorter than the subframe length N. In another representation, the pitch contribution can be seen as a pitch codebook containing the past excitation signal. Generally, each vector in the pitch codebook is a shift-by-one version of the previous vector (discarding one sample and adding a new sample). For pitch lags T>N, the pitch codebook is equivalent to the filter structure (1/(1−bz−T), and the pitch codebook vector vT(n) at pitch lag T is given by $$v_T(n)=u(n-T),\ n=0,\ \ldots\ ,N-1.$$

For pitch lags T shorter than N, a vector vT(n) is built by repeating the available samples from the past excitation until the vector is completed (this is not equivalent to the filter structure).

In recent encoders, a higher pitch resolution is used which significantly improves the quality of voiced sound segments. This is achieved by oversampling the past excitation signal using polyphase interpolation filters. In this case, the vector vT(n) usually corresponds to an interpolated version of the past excitation, with pitch lag T being a non-integer delay (e.g. 50.25).

The pitch search consists of finding the best pitch lag T and gain b that minimize the mean squared weighted error E between the target vector x and the scaled filtered past excitation. Error E being expressed as:

$$E=\|x-by_T\|^2$$

where yT is the filtered pitch codebook vector at pitch lag T:

$$y_T(n)=v_T(n)*h(n)=\sum_{i=0}^{n}v_T(i)h(n-i),\ n=0,\ \ldots\ ,N-1.$$

It can be shown that the error E is minimized by maximizing the search criterion $$C=\frac{x^t y_T}{\sqrt{y_T^t y_T}}$$

where t denotes vector transpose.

In the preferred embodiment of the present invention, a ⅓ subsample pitch resolution is used, and the pitch (pitch codebook) search is composed of three stages.

In the first stage, the open-loop pitch lag TOL is estimated in open-loop pitch search module 106 in response to the weighted speech signal sw(n). As indicated in the foregoing description, this open-loop pitch analysis is usually performed once every 10 ms (two subframes) using techniques well known to those of ordinary skill in the art.

In the second stage, the search criterion C is searched in the closed-loop pitch search module 107 for integer pitch lags around the estimated open-loop pitch lag TOL (usually ±5), which significantly simplifies the search procedure. A simple procedure can be used for updating the filtered codevector yT without the need to compute the convolution for every pitch lag.

Once an optimum integer pitch lag is found in the second stage, a third stage of the search (module 107) tests the fractions around that optimum integer pitch lag.

When the pitch predictor is represented by a filter of the form 1/(1−bz−T), which is a valid assumption for pitch lags T>N, the spectrum of the pitch filter exhibits a harmonic structure over the entire frequency range, with a harmonic frequency related to 1/T. In the case of wideband signals, this structure is not very efficient since the harmonic structure in wideband signals does not cover the entire extended spectrum. The harmonic structure exists only up to a certain frequency, depending on the speech segment. Thus, in order to achieve efficient representation of the pitch contribution in voiced segments of wideband speech, the pitch prediction filter needs to have the flexibility of varying the amount of periodicity over the wideband spectrum.

A new method which achieves efficient modelling of the harmonic structure of the speech spectrum of wideband signals is disclosed in the present specification, whereby several forms of low-pass filters are applied to the past excitation and the low-pass filter with higher prediction gain is selected.

When subsample pitch resolution is used, the low-pass filters can be incorporated into the interpolation filters used to obtain the higher pitch resolution. In this case, the third stage of the pitch search, in which the fractions around the chosen integer pitch lag are tested, is repeated for the several interpolation filters having different low-pass characteristics and the fraction and filter index which maximize the search criterion C are selected.

A simpler approach is to complete the search in the three stages described above to determine the optimum fractional pitch lag using only one interpolation filter with a certain frequency response, and select the optimum low-pass filter shape at the end by applying the different predetermined low-pass filters to the chosen pitch codebook vector vT and select the low-pass filter which minimizes the pitch prediction error. This approach is discussed in detail below.

Figure 3:
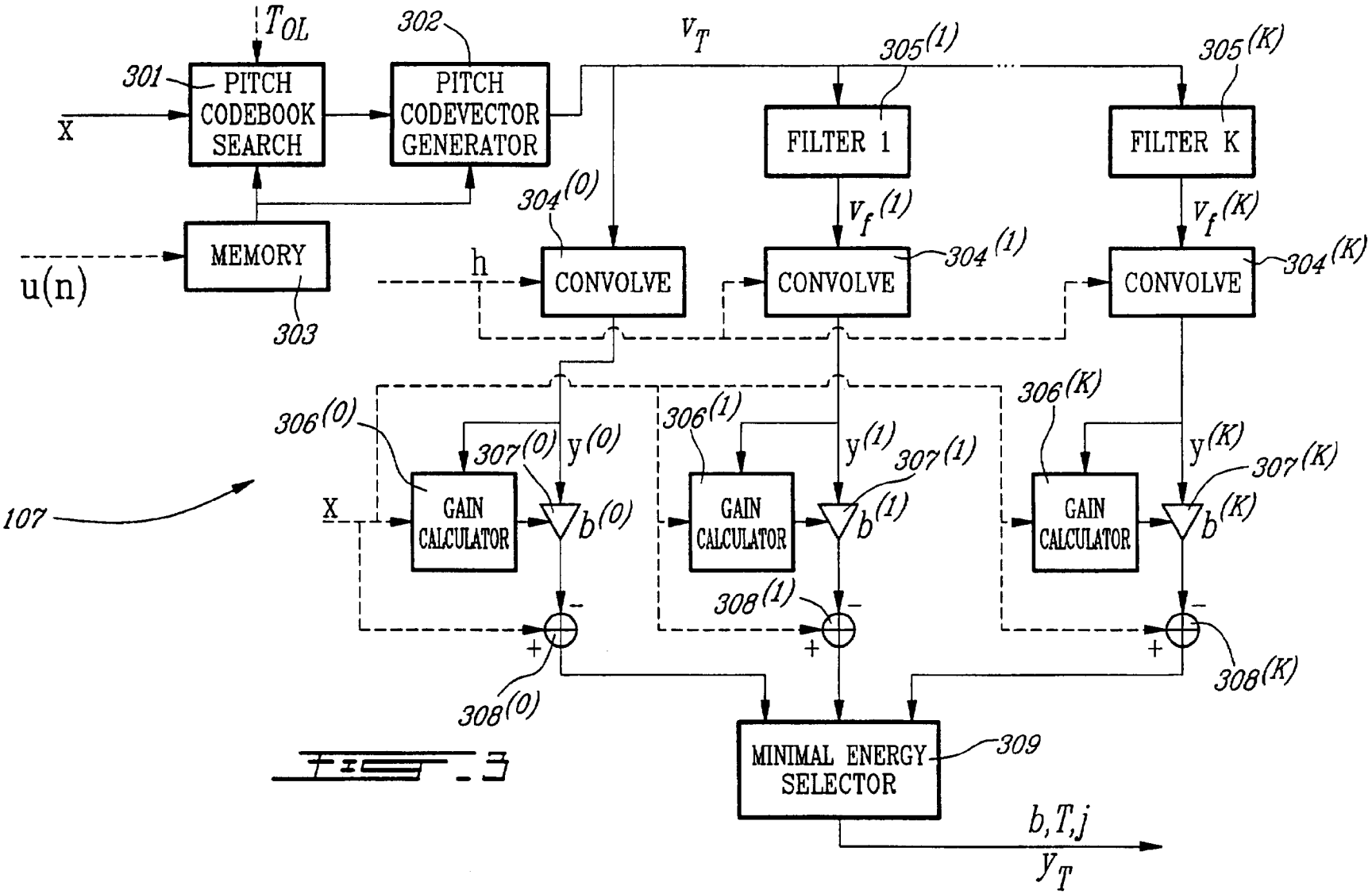
FIG. 3 is a schematic block diagram of a pitch analysis device.

FIG. 3 illustrates a schematic block diagram of a preferred embodiment of the proposed approach.

In memory module 303, the past excitation signal u(n), n<0, is stored. The pitch codebook search module 301 is responsive to the target vector x, to the open-loop pitch lag TOL and to the past excitation signal u(n), n<0, from memory module 303 to conduct a pitch codebook (pitch codebook) search minimizing the above-defined search criterion C. From the result of the search conducted in module 301, module 302 generates the optimum pitch codebook vector vT. Note that since a sub-sample pitch resolution is used (fractional pitch), the past excitation signal u(n), n<0, is interpolated and the pitch codebook vector vT corresponds to the interpolated past excitation signal. In this preferred embodiment, the interpolation filter (in module 301, but not shown) has a low-pass filter characteristic removing the frequency contents above 7000 Hz.

In a preferred embodiment, K filter characteristics are used; these filter characteristics could be low-pass or band-pass filter characteristics. Once the optimum codevector vT is determined and supplied by the pitch codevector generator 302, K filtered versions of codevector vT are computed respectively using K different frequency shaping filters such as 305(*j*), where j=1, 2, . . . , K. These filtered versions are denoted vf(j), where j=1, 2, . . . , K. The different vectors vf(j) are convolved in respective modules 304(*j*), where j=0, 1, 2, . . . , K, with the impulse response h to obtain the vectors y(j), where j=0, 1, 2, . . . , K. To calculate the mean squared pitch prediction error for each vector y(j), the value y(j) is multiplied by the gain b by means of a corresponding amplifier 307(*j*) and the value by(j) is subtracted from the target vector x by means of a corresponding subtractor 308(*j*). Selector 309 selects the frequency shaping filter 305(*j*) which minimizes the mean squared pitch prediction error $$e^{(j)} = \|x - b^{(j)}y^{(j)}\|^2, \quad j = 1.2, \ldots, K$$

To calculate the mean squared pitch prediction error e(j) for each value of y(j), the value y(j) is multiplied by the gain b by means of a corresponding amplifier 307(*j*) and the value b(j)y(j) is subtracted from the target vector x by means of subtractors 308(*j*). Each gain b(j) is calculated in a corresponging gain calculator 306(*j*) in association with the frequency shaping filter at index j, using the following relationship:

$$b^{(j)} = x^t y^{(j)} / \|y^{(j)}\|^2.$$

In selector 309, the parameters b, T, and j are chosen based on vT or vf(j) which minimizes the mean squared pitch prediction error e.

Referring back to FIG. 1, the pitch codebook index T is encoded and transmitted to multiplexer 112. The pitch gain b is quantized and transmitted to multiplexer 112. With this new approach, extra information is needed to encode the index j of the selected frequency shaping filter in multiplexer 112. For example, if three filters are used (j=0, 1, 2, 3), then two bits are needed to represent this information. The filter index information j can also be encoded jointly with the pitch gain b.

Innovative Codebook Search:

Once the pitch, or LTP (Long Term Prediction) parameters b, T, and j are determined, the next step is to search for the optimum innovative excitation by means of search module 110 of FIG. 1. First, the target vector x is updated by subtracting the LTP contribution:

$$x' = x - by_T$$

where b is the pitch gain and yT is the filtered pitch codebook vector (the past excitation at delay T filtered with the selected low-pass filter and convolved with the inpulse response h as described with reference to FIG. 3).

The search procedure in CELP is performed by finding the optimum excitation codevector ck and gain g which minimize the mean-squared error E between the target vector and the scaled filtered codevector $$E = \|x' - gH_{Ck}\|^2$$

where H is a lower triangular convolution matrix derived from the impulse response vector h.

In the preferred embodiment of the present invention, the innovative codebook search is performed in module 110 by means of an algebraic codebook as described in U.S. Pat. No. 5,444,816 (Adoul et al.) issued on Aug. 22, 1995; U.S. Pat. No. 5,699,482 granted to Adoul et al., on Dec. 17, 1997; U.S. Pat. No. 5,754,976 granted to Adoul et al., on May 19, 1998; and U.S. Pat. No. 5,701,392 (Adoul et al.) dated Dec. 23, 1997.

Once the optimum excitation codevector ck and its gain g are chosen by module 110, the codebook index k and gain g are encoded and transmitted to multiplexer 112.

Referring to FIG. 1, the parameters b, T, j, Â(z), k and g are multiplexed through the multiplexer 112 before being transmitted through a communication channel.

Memory Update:

In memory module 111 (FIG. 1), the states of the weighted synthesis filter W(z)/Â(z) are updated by filtering the excitation signal u=gck+bvT through the weighted synthesis filter. After this filtering, the states of the filter are memorized and used in the next subframe as initial states for computing the zero-input response in calculator module 108.

As in the case of the target vector x, other alternative but mathematically equivalent approaches well known to those of ordinary skill in the art can be used to update the filter states.

DECODER 200

Figure 2:
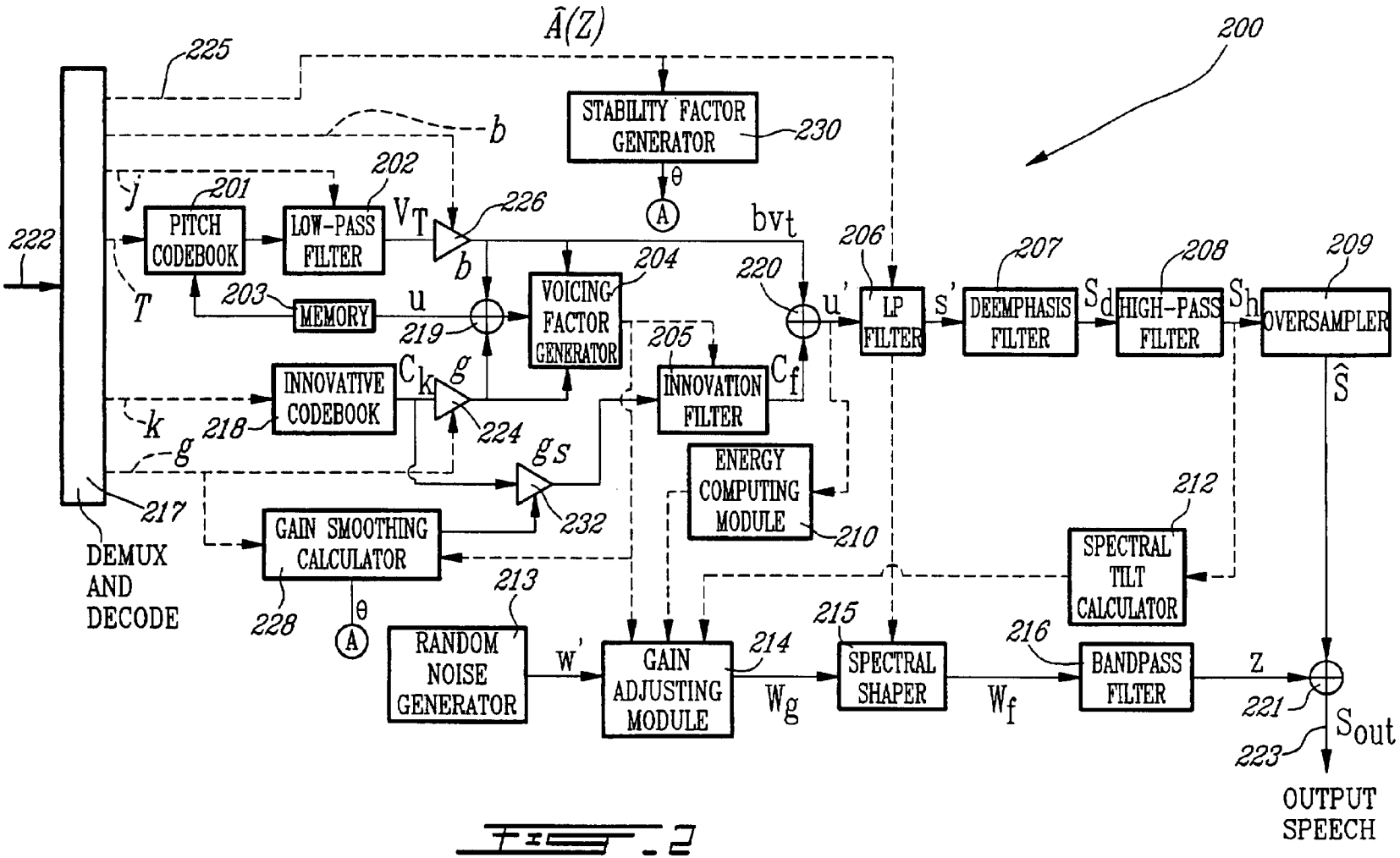
FIG. 2 is a schematic block diagram of a wideband decoder embodying gain-smoothing method and device according to the invention.

The speech decoding device 200 of FIG. 2 illustrates the various steps carried out between the digital input 222 (input stream to the demultiplexer 217) and the output sampled speech 223 (output of the adder 221).

Demultiplexer 217 extracts the synthesis model parameters from the binary information received from a digital input channel. From each received binary frame, the extracted parameters are:

- the short-term prediction parameters (STP) Â(z) (once per frame);
- the long-term prediction (LTP) parameters T, b, and j (for each subframe); and
- the innovation codebook index k and gain g (for each subframe).

The current speech signal is synthesized based on these parameters as will be explained hereinbelow.

The innovative codebook 218 is responsive to the index k to produce the innovation codevector ck, which is scaled by the decoded gain factor g through an amplifier 224. In the preferred embodiment, an innovative codebook 218 as described in the above mentioned U.S. Pat. Nos. 5,444,816; 5,699,482; 5,754,976; and 5,701,392 is used to represent the innovative codevector ck.

The generated scaled codevector gck at the output of the amplifier 224 is processed through a innovation filter 205.

Gain Smoothing

At the decoder 200 of FIG. 2, a nonlinear gain-smoothing technique is applied to the innovative codebook gain g in order to improve background noise performance. Based on the stationarity (or stability) and voicing of the speech segment of the wideband signal, the gain g of the innovative codebook 218 is smoothed in order to reduce fluctuation in the energy of the excitation in case of stationary signals. This improves the codec performance in the presence of stationary background noise.

In a preferred embodiment, two parameters are used to control the amount of smoothing: i.e., the voicing of the subframe of wideband signal and the stability of the LP (Linear Prediction) filter 206 both indicative of stationary background noise in the wideband signal.

Different methods can be used for estimating the degree of voicing in the subframe.

Figure 5:
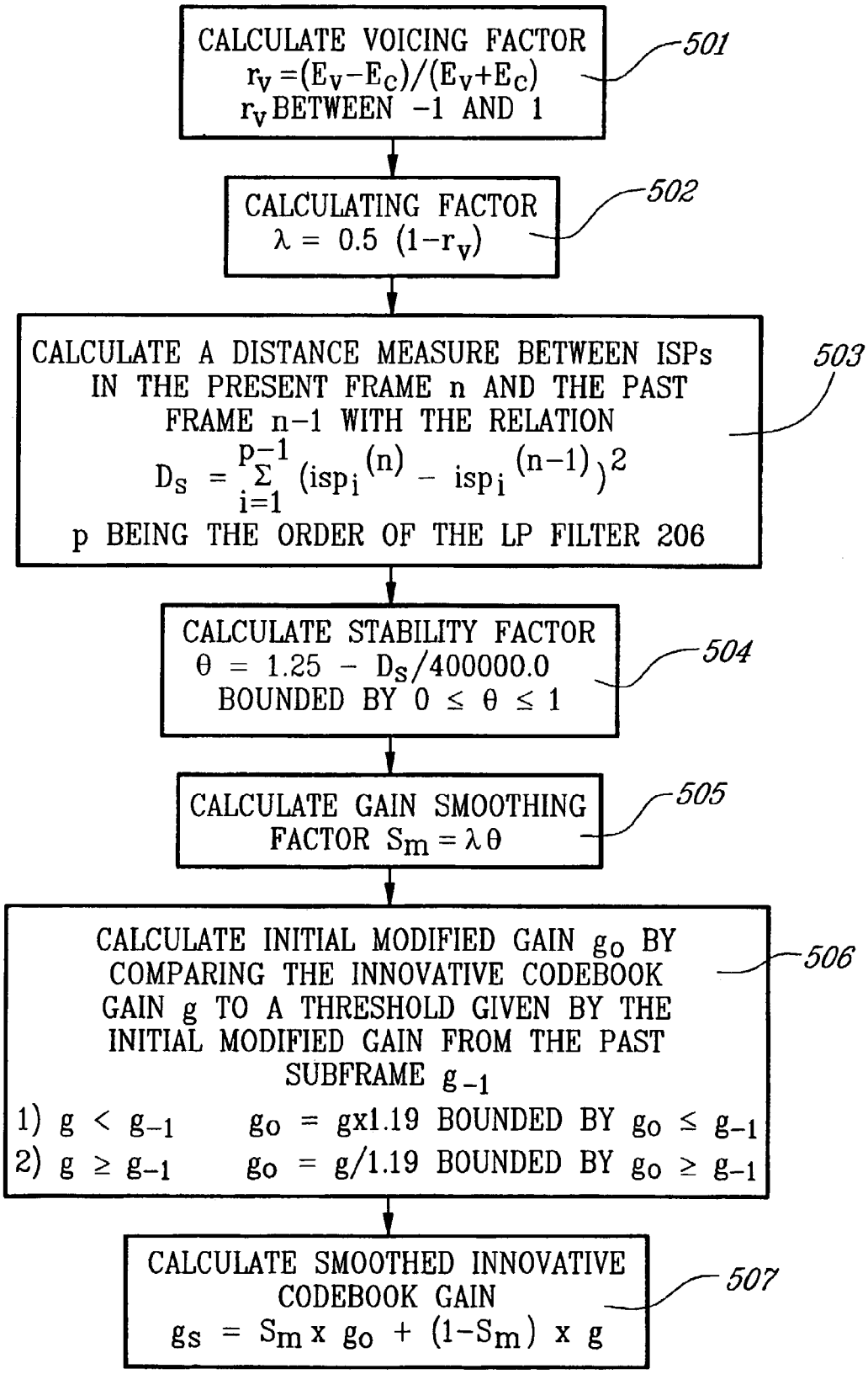
FIG. 5 is a simplified, schematic block diagram of a cellular communication system in which the wideband encoder of FIG. 1 and the wideband decoder of FIG. 2 can be used.

Step 501 (FIG. 5):

In a preferred embodiment a voicing factor rv is computed in the voicing factor generator 204 using the following relation:

$$rv=(Ev-Ec)/(Ev+Ec)$$

where Ev is the energy of the scaled pitch codevector bvT and Ec is the energy of the scaled innovative codevector gck. That is $$E_v = b^2 v_T^1 v_T = b^2 \sum_{n=0}^{N-1} v_T^2(n) \text{ and } E_c = g^2 c_k^1 c_k = g^2 \sum_{n=0}^{N-1} c_k^2(n)$$

Note that the value of voicing factor rv lies between −1 and 1, where a value of 1 corresponds to pure voiced signals and a value of −1 corresponds to pure unvoiced signals.

Step 502 (FIG. 5):

A factor λ is computed in the gain-smoothing calculator 228 based on rv through the following relation:

$$\lambda=0.5(1-rv)$$

Note that the factor λ is related to the amount of unvoicing, that is λ=0 for pure voiced segments and λ=1 for pure unvoiced segments.

Step 503 (FIG. 5):

A stability factor θ is computed in a stability factor generator 230 based on a distance measure which gives the similarity of the adjacent LP filters. Different similarity measures can be used. In this preferred embodiment, the LP coefficients are quantized and interpolated in the Immitance Spectral Pair (ISP). It is therefore convenient to derive the distance measure in the ISP domain. Alternatively, the Line Spectral Frequency (LSF) representation of the LP filter can equally be used to find the similarity distance of adjacent LP filters. Other measures have also been used in the previous art such as the Itakura measure.

In a preferred embodiment, the ISP distance measure between the ISPs in the present frame n and the past frame n−1 is calculated in stability factor generator 230 and is given by the relation:

$$D_s = \sum_{i=1}^{p-1} (isp_i^{(n)} - isp_i^{(n-1)})^2$$

where p is the order of the LP filter 206. Note that the first p−1 ISPs being used are frequencies in the range 0 to 8000 Hz.

Step 504 (FIG. 5):

The ISP distance measure is mapped in gain-smoothing calculator 228 to a stability factor θ in the range 0 to 1, and derived by $$\theta = 1.25 - D_s/400000.0 \text{ bounded by } 0 \le \theta \le 1.$$

Note that larger values of θ correspond to more stable signals.

Step 505 (FIG. 5):

A gain smoothing factor Sm based on both voicing and stability is then calculated in gain smoothing calculator 228 and is given by $$S_m=\lambda\theta$$

The value of Sm approaches 1 for unvoiced and stable signals, which is the case of stationary background noise signals. For pure voiced signals or for unstable signals, the value of Sm approaches 0.

Step 506 (FIG. 5):

An initial modified gain g0 is computed in gain smoothing calculator 228 by comparing the innovative codebook gain g to a threshold given by the initial modified gain from the past subframe, g−1. If g is larger or equal to g−1, then g0 is computed by decrementing g by 1.5 dB bounded by g0≧g1. If g is smaller than g−1, then g0 is computed by incrementing g by 1.5 dB bounded by g0≦g−1. Note that incrementing the gain by 1.5 dB is equivalent to multiplying by 1.19. In other words

| | | | |
|---|---|---|---|
| | if g < g − 1 then | g0 = g*1.19 | bounded by g0 ≦ g − 1 |
| and | | | |
| | if g ≧ g − 1 then | g0 = g/1.19 | bounded by g0 ≧ g − 1 |

Step 507 (FIG. 5):

Finally, the smoothed fixed codebook gain gs is calculated in gain smoothing calculator 228 by $$g_s=S_m*g_0+(1-S_m)*g$$

The smoothed gain gs is then used for scaling the innovative codevector ck in amplifier 232.

Just a word to mention that the above gain smoothing procedure can be applied to signals other than wideband signals.

Periodicity Enhancement:

The generated scaled codevector at the output of the amplifier 224 is processed through a frequency-dependent pitch enhancer 205.

Enhancing the periodicity of the excitation signal u improves the quality in case of voiced segments. This was done in the past by filtering the innovation vector from the innovative codebook (fixed codebook) 218 through a filter in the form $1/(1-\epsilon bz-T)$ where $\epsilon$ is a factor below 0.5 which controls the amount of introduced periodicity. This approach is less efficient in case of wideband signals since it introduces periodicity over the entire spectrum. A new alternative approach, which is part of the present invention, is disclosed whereby periodicity enhancement is achieved by filtering the innovative codevector ck from the innovative (fixed) codebook through an innovation filter 205 (F(z)) whose frequency response emphasizes the higher frequencies more than lower frequencies. The coefficients of F(z) are related to the amount of periodicity in the excitation signal u.

Many methods known to those skilled in the art are available for obtaining valid periodicity coefficients. For example, the value of gain b provides an indication of periodicity. That is, if gain b is close to 1, the periodicity of the excitation signal u is high, and if gain b is less than 0.5, then periodicity is low.

Another efficient way to derive the filter F(z) coefficients used in a preferred embodiment, is to relate them to the amount of pitch contribution in the total excitation signal u. This results in a frequency response depending on the subframe periodicity, where higher frequencies are more strongly emphasized (stronger overall slope) for higher pitch gains. Innovation filter 205 has the effect of lowering the energy of the innovative codevector ck at low frequencies when the excitation signal u is more periodic, which enhances the periodicity of the excitation signal u at lower frequencies more than higher frequencies. Suggested forms for innovation filter 205 are $$F(z)=1-\sigma_z^{-1}, \tag{1}$$

or $$F(z)=\alpha z+1-\alpha_z^{-1} \tag{2}$$

where $\sigma$ or $\alpha$ are periodicity factors derived from the level of periodicity of the excitation signal u.

The second three-term form of F(z) is used in a preferred embodiment. The periodicity factor $\alpha$ is computed in the voicing factor generator 204. Several methods can be used to derive the periodicity factor $\alpha$ based on the periodicity of the excitation signal u. Two methods are presented below.

Method 1:

The ratio of pitch contribution to the total excitation signal u is first computed in voicing factor generator 204 by $$R_p = \frac{b^2 v_T^1 v_T}{u^1 u} = \frac{b^2 \sum_{n=0}^{N-1} v_T^2(n)}{\sum_{n=0}^{N-1} u^2(n)}$$

where vT is the pitch codebook vector, b is the pitch gain, and u is the excitation signal u given at the output of the adder 219 by $$u=gck+bvT$$

Note that the term bvT has its source in the pitch codebook (adaptive codebook) 201 in response to the pitch lag T and the past value of u stored in memory 203. The pitch codevector vT from the pitch codebook 201 is then processed through a low-pass filter 202 whose cut-off frequency is adjusted by means of the index j from the demultiplexer 217. The resulting codevector vT is then multiplied by the gain b from the demultiplexer 217 through an amplifier 226 to obtain the signal bvT.

The factor $\alpha$ is calculated in voicing factor generator 204 by $$\alpha=qRp \text{ bounded by } \alpha<q$$

where q is a factor which controls the amount of enhancement (q is set to 0.25 in this preferred embodiment).

Method 2:

Another method used in a preferred embodiment of the invention for calculating periodicity factor $\alpha$ is discussed below.

First, a voicing factor rv is computed in voicing factor generator 204 by $$r_v = (E_v - E_c)/(E_v + E_c)$$

where Ev is the energy of the scaled pitch codevector bvT and Ec is the energy of the scaled innovative codevector gck. That is $$E_v = b^2 v_T^1 v_T = b^2 \sum_{n=0}^{N-1} v_T^2(n) \text{ and } E_c = g^2 c_k^1 c_k = g^2 \sum_{n=0}^{N-1} c_k^2(n)$$

Note that the value of rv lies between −1 and 1 (1 corresponds to purely voiced signals and −1 corresponds to purely unvoiced signals).

In this preferred embodiment, the factor $\sigma$ is then computed in voicing factor generator 204 by $$\sigma=0.125(1+rv)$$

which corresponds to a value of 0 for purely unvoiced signals and 0.25 for purely voiced signals.

In the first, two-term form of F(z), the periodicity factor $\sigma$ can be approximated by using $\sigma=2\alpha$ in methods 1 and 2 above. In such a case, the periodicity factor $\sigma$ is calculated as follows in method 1 above:

$$\sigma=2qRp \text{ bounded by } \sigma<2q.$$

In method 2, the periodicity factor $\sigma$ is calculated as follows:

$$\sigma=0.25(1+rv).$$

The enhanced signal cf is therefore computed by filtering the scaled innovative codevector gck through the innovation filter 205 (F(z)).

The enhanced excitation signal u' is computed by the adder 220 as:

$$u'=cf+bvT$$

Note that this process is not performed at the encoder 100. Thus, it is essential to update the content of the pitch codebook 201 using the excitation signal u without enhancement to keep synchronism between the encoder 100 and decoder 200. Therefore, the excitation signal u is used to update the memory 203 of the pitch codebook 201 and the enhanced excitation signal u' is used at the input of the LP synthesis filter 206.

Synthesis and Deemphasis

The synthesized signal s' is computed by filtering the enhanced excitation signal u' through the LP synthesis filter 206 which has the form $1/\hat{A}(z)$, where $\hat{A}(z)$ is the interpolated LP filter in the current subframe. As can be seen in FIG. 2, the quantized LP coefficients $\hat{A}(z)$ on line 225 from demultiplexer 217 are supplied to the LP synthesis filter 206 to adjust the parameters of the LP synthesis filter 206 accordingly. The deemphasis filter 207 is the inverse of the preemphasis filter 103 of FIG. 1. The transfer function of the deemphasis filter 207 is given by $$D(z) = 1/(1-\mu_z^{-1})$$

where μ is a preemphasis factor with a value located between 0 and 1 (a typical value is μ=0.7). A higher-order filter could also be used.

The vector s' is filtered through the deemphasis filter D(z) (module 207) to obtain the vector sd, which is passed through the high-pass filter 208 to remove the unwanted frequencies below 50 Hz and further obtain sh.

Oversampling and High-Frequency Regeneration

The over-sampling module 209 conducts the inverse process of the down-sampling module 101 of FIG. 1. In this preferred embodiment, oversampling converts from the 12.8 kHz sampling rate to the original 16 kHz sampling rate, using techniques well known to those of ordinary skill in the art. The oversampled synthesis signal is denoted §. Signal § is also referred to as the synthesized wideband intermediate signal.

The oversampled synthesis § signal does not contain the higher frequency components which were lost by the down-sampling process (module 101 of FIG. 1) at the encoder 100. This gives a low-pass perception to the synthesized speech signal. To restore the full band of the original signal, a high frequency generation procedure is disclosed. This procedure is performed in modules 210 to 216, and adder 221, and requires input from voicing factor generator 204 (FIG. 2).

In this new approach, the high frequency contents are generated by filling the upper part of the spectrum with a white noise properly scaled in the excitation domain, then converted to the speech domain, preferably by shaping it with the same LP synthesis filter used for synthesizing the down-sampled signal §.

The high frequency generation procedure is described hereinbelow.

The random noise generator 213 generates a white noise sequence w' with a flat spectrum over the entire frequency bandwidth, using techniques well known to those of ordinary skill in the art. The generated sequence has a length N' which is the subframe length in the original domain. Note that N is the subframe length in the down-sampled domain. In this preferred embodiment, N=64 and N'=80 which correspond to 5 ms.

The white noise sequence is properly scaled in the gain adjusting module 214. Gain adjustment comprises the following steps. First, the energy of the generated noise sequence w' is set equal to the energy of the enhanced excitation signal u' computed by an energy computing module 210, and the resulting scaled noise sequence is given by $$w(n) = w'(n)\sqrt{\frac{\sum_{n=0}^{N-1} u'^2(n)}{\sum_{n=0}^{N'-1} w'^2(n)}}, \quad n = 0, \ldots, N'-1.$$

The second step in the gain scaling is to take into account the high frequency contents of the synthesized signal at the output of the voicing factor generator 204 so as to reduce the energy of the generated noise in case of voiced segments (where less energy is present at high frequencies compared to unvoiced segments). In this preferred embodiment, measuring the high frequency contents is implemented by measuring the tilt of the synthesis signal through a spectral tilt calculator 212 and reducing the energy accordingly. Other measurements such as zero crossing measurements can equally be used. When the tilt is very strong, which corresponds to voiced segments, the noise energy is further reduced. The tilt factor is computed in module 212 as the first correlation coefficient of the synthesis signal sh and it is given by:

$$tilt = \frac{\sum_{n=1}^{N-1} s_h(n)s_h(n-1)}{\sum_{n=0}^{N-1} S_h^2(n)},$$

conditioned by tilt≧0 and tilt≧rv.

where voicing factor rv is given by $$r_v=(E_v-E_c)/(E_v+E_c)$$

where Ev is the energy of the scaled pitch codevector bvT and Ec is the energy of the scaled innovative codevector gck, as described earlier. Voicing factor rv is most often less than tilt but this condition was introduced as a precaution against high frequency tones where the tilt value is negative and the value of rv is high. Therefore, this condition reduces the noise energy for such tonal signals.

The tilt value is 0 in case of flat spectrum and 1 in case of strongly voiced signals, and it is negative in case of unvoiced signals where more energy is present at high frequencies.

Different methods can be used to derive the scaling factor gt from the amount of high frequency contents. In this invention, two methods are given based on the tilt of signal described above.

Method 1:

The scaling factor gt is derived from the tilt by $$gt=1-\text{tilt bounded by } 0.2 \leqq gt \leqq 1.0$$

For strongly voiced signal where the tilt approaches 1, gt is 0.2 and for strongly unvoiced signals gt becomes 1.0.

Method 2:

The tilt factor gt is first restricted to be larger or equal to zero, then the scaling factor is derived from the tilt by $$g_t = 10^{-0.6tilt}$$

The scaled noise sequence wg produced in gain adjusting module 214 is therefore given by:

$$wg=gtw.$$

When the tilt is close to zero, the scaling factor gt is close to 1, which does not result in energy reduction. When the tilt value is 1, the scaling factor gt results in a reduction of 12 dB in the energy of the generated noise.

Once the noise is properly scaled (wg), it is brought into the speech domain using the spectral shaper 215. In the preferred embodiment, this is achieved by filtering the noise wg through a bandwidth expanded version of the same LP synthesis filter used in the down-sampled domain (1/Â(z/0.8)). The corresponding bandwidth expanded LP filter coefficients are calculated in spectral shaper 215.

The filtered scaled noise sequence wf is then band-pass filtered to the required frequency range to be restored using the band-pass filter 216. In the preferred embodiment, the band-pass filter 216 restricts the noise sequence to the frequency range 5.6–7.2 kHz. The resulting band-pass filtered noise sequence z is added in adder 221 to the over-sampled synthesized speech signal s' to obtain the final reconstructed sound signal sout on the output 223.

Although the present invention has been described hereinabove by way of a preferred embodiment thereof, this embodiment can be modified at will, within the scope of the appended claims, without departing from the spirit and nature of the subject invention. Even though the preferred embodiment discusses the use of wideband speech signals, it will be obvious to those skilled in the art that the subject invention is also directed to other embodiments using wideband signals in general and that it is not necessarily limited to speech applications.

The invention claimed is:

1. A method for producing a gain-smoothed codevector during decoding of an encoded wideband signal from a set of wideband signal encoding parameters, said method comprising:

finding a codevector in relation to at least one first wideband signal encoding parameter of said set;

calculating a first factor representative of voicing in the wideband signal in response to at least one second wideband signal encoding parameter of said set;

calculating a second factor representative of stability of said wideband signal in response to at least one third wideband signal encoding parameter of said set;

calculating a smoothing gain based on said first and second factors; and amplifying the found codevector with said smoothing gain to thereby produce said gain-smoothed codevector.

2. A gain-smoothed codevector producing method as claimed in claim 1, wherein:

finding a codevector comprises finding an innovative codevector in an innovative codebook in relation to said at least one first wideband signal encoding parameter; and the smoothing gain calculation comprises calculating the smoothing gain also in relation to an innovative codebook gain forming a fourth wideband signal encoding parameter of said set.

3. A gain-smoothed codevector producing method as claimed in claim 1, wherein:

finding a codevector comprises finding a codevector in a codebook in relation to said at least one first wideband signal encoding parameter; and said at least one first wideband signal encoding parameter comprises an innovative codebook index.

4. A gain-smoothed codevector producing method as claimed in claim 1, wherein:

finding a codevector comprises finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

5. A gain-smoothed codevector producing method as claimed in claim 1, wherein said at least one third wideband signal encoding parameter comprises coefficients of a linear prediction filter calculated during encoding of the wideband signal.

6. A gain-smoothed codevector producing method as claimed in claim 1, wherein:

finding a codevector comprises finding an innovative codevector in an innovative codebook in relation to an index k of said innovative codebook, said index k forming said at least one first wideband signal encoding parameter; and calculating a first factor comprises computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

7. A gain-smoothed codevector producing method as claimed in claim 6, wherein the voicing factor rv has a value located between −1 and 1, wherein value 1 corresponds to a pure voiced signal and value −1 corresponds to a pure unvoiced signals.

8. A gain-smoothed codevector producing method as claimed in claim 7, wherein calculating a smoothing gain comprises computing a factor λ using the following relation:

$$\lambda=0.5(1-rv).$$

9. A gain-smoothed codevector producing method as claimed in claim 6, wherein a factor $\lambda=0$ indicates a pure voiced signal and a factor $\lambda=1$ indicates a pure unvoiced signal.

10. A gain-smoothed codevector producing method as claimed in claim 1, wherein calculating a second factor comprises determining a distance measure giving a similarity between adjacent, successive linear prediction filters computed during encoding of the wideband signal.

11. A gain-smoothed codevector producing method as claimed in claim 10, wherein:

the wideband signal is sampled prior to encoding, and is processed by frames during encoding and decoding; and determining a distance measure comprises calculating an Immitance Spectral Pair distance measure between the Immitance Spectral Pairs in a present frame n of the wideband signal and the Immitance Spectral Pairs of a past frame n−1 of the wideband signal through the following relation:

$$D_s = \sum_{i=1}^{p-1} (isp_i^{(n)} - ispSUBt^{(n-1)})^2$$

where p is the order of the linear prediction filters.

12. A gain-smoothed codevector producing method as claimed in claim 11, wherein calculating a second factor comprises mapping the Immitance Spectral Pair distance measure $D_s$ to said second factor $\theta$ through the following relation:

$$\theta=1.25-D_s/400000.0$$

bounded by $0 \leqq \theta \leqq 1$.

13. A gain-smoothed codevector producing method as claimed in claim 1, wherein calculating a smoothing gain comprises calculating a gain smoothing factor $S_m$ based on both the first $\lambda$ and second $\theta$ factors through the following relation:

$$S_m=\lambda\theta.$$

14. A gain-smoothed codevector producing method as claimed in claim 13, wherein the factor $S_m$ has a value approaching 1 for an unvoiced and stable wideband signal, and a value approaching 0 for a pure voiced wideband signal or an unstable wideband signal.

15. A gain-smoothed codevector producing method as claimed in claim 1, wherein:

finding a codevector comprises finding an innovative codevector in an innovative codebook in relation to said at least one first wideband signal encoding parameter;

the wideband signal is sampled prior to encoding, and is processed by frames and subframes during encoding and decoding; and calculating a smoothing gain comprises computing an initial modified gain $g_0$ by comparing an innovative codebook gain g computed during encoding of the wideband signal to a threshold given by the initial modified gain from the past subframe g−1 as follows:

| | | |
|---|---|---|
| if $g < g - 1$ then | $g_0 = g \times 1.19$ | bounded by $g_0 \leqq g - 1$ |
| and | | |
| if $g \geqq g - 1$ then | $g_0 = g/1.19$ | bounded by $g_0 \geqq g - 1$. |

16. A gain-smoothed codevector producing method as claimed in claim 15, wherein calculating a smoothing gain comprises:

calculating a gain smoothing factor $S_m$ based on both the first $\lambda$ and second $\theta$ factors through the following relation:

$$S_m=\lambda\theta; \text{ and}$$

determining said smoothing gain through the following relation:

$$g_s=S_m*g_0+(1-S_m)*g.$$

17. A method for producing a gain-smoothed codevector during decoding of an encoded signal from a set of signal encoding parameters, said signal containing stationary background noise and said method comprising:

finding a codevector in relation to at least one first signal encoding parameter of said set;

calculating at least one factor representative of stationary background noise in the signal in response to at least one second signal encoding parameter of said set;

calculating a smoothing gain using a non linear operation based on said noise representative factor; and amplifying the found codevector with said smoothing gain to thereby produce said gain-smoothed codevector.

18. A method for producing a gain-smoothed codevector during decoding of an encoded wideband signal from a set of wideband signal encoding parameters, said method comprising:

finding a codevector in relation to at least one first wideband signal encoding parameter of said set;

calculating a factor representative of voicing in the wideband signal in response to at least one second wideband signal encoding parameter of said set;

calculating a smoothing gain using a non linear operation based on said voicing representative factor; and amplifying the found codevector with said smoothing gain to thereby produce said gain-smoothed codevector.

19. A method for producing a gain-smoothed codevector during decoding of an encoded wideband signal from a set of wideband signal encoding parameters, said method comprising:

finding a codevector in relation to at least one first wideband signal encoding parameter of said set;

calculating a factor representative of stability of said wideband signal in response to at least one second wideband signal encoding parameter of said set;

calculating a smoothing gain using a non linear operation based on said stability representative factor; and amplifying the found codevector with said smoothing gain to thereby produce said gain-smoothed codevector.

20. A device for producing a gain-smoothed codevector during decoding of an encoded wideband signal from a set of wideband signal encoding parameters, said device comprising:

a codevector finder supplied with at least one first wideband signal encoding parameter of said set, and delivering a codevector found in relation to said at least one first wideband signal encoding parameter;

a voicing factor calculator supplied with at least one second wideband signal encoding parameter of said set, and delivering a first factor representative of voicing in the wideband signal in response to said at least one second wideband signal encoding parameter;

a stability factor calculator supplied with at least one third wideband signal encoding parameter of said set, and delivering a second factor representative of stability of said wideband signal in response to said at least one third wideband signal encoding parameter;

a smoothing gain calculator supplied with the first and second factors, and delivering a smoothing gain based on said first and second factors;

and an amplifier supplied with both the found codevector and the smoothing gain, and amplifying said found codevector with said smoothing gain to thereby produce said gain-smoothed codevector.

21. A device for producing a gain-smoothed codevector during decoding of an encoded wideband signal from a set of wideband signal encoding parameters, said device comprising:

means for finding a codevector in relation to at least one first wideband signal encoding parameter of said set;

means for calculating a first factor representative of voicing in the wideband signal in response to at least one second wideband signal encoding parameter of said set;

means for calculating a second factor representative of stability of said wideband signal in response to at least one third wideband signal encoding parameter of said set;

means for calculating a smoothing gain based on said first and second factors; and means for amplifying the found codevector with said smoothing gain to thereby produce said gain-smoothed codevector.

22. A gain-smoothed codevector producing device as claimed in claim 21, wherein:

the means for finding a codevector comprises means for finding an innovative codevector in an innovative codebook in relation to said at least one first wideband signal encoding parameter; and the smoothing gain calculating means comprises means for calculating the smoothing gain also in relation to an innovative codebook gain forming a fourth wideband signal encoding parameter of said set.

23. A gain-smoothed codevector producing device as claimed in claim 21, wherein:

the means for finding a codevector comprises means for finding a codevector in a codebook in relation to said at least one first wideband signal encoding parameter; and said at least one first wideband signal encoding parameter comprises an innovative codebook index.

24. A gain-smoothed codevector producing device as claimed in claim 21, wherein:

the means for finding a codevector comprises means for finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

25. A gain-smoothed codevector producing device as claimed in claim 21, wherein said at least one third wideband signal encoding parameter comprises coefficients of a linear prediction filter calculated during encoding of the wideband signal.

26. A gain-smoothed codevector producing device as claimed in claim 21, wherein:

the means for finding a codevector comprises means for finding an innovative codevector in an innovative codebook in relation to an index k of said innovative codebook, said index k forming said at least one first wideband signal encoding parameter; and the means for calculating a first factor comprises means for computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

27. A gain-smoothed codevector producing device as claimed in claim 26, wherein the voicing factor rv has a value located between −1 and 1, wherein value 1 corresponds to a pure voiced signal and value −1 corresponds to a pure unvoiced signals.

28. A gain-smoothed codevector producing device as claimed in claim 27, wherein the means for calculating a smoothing gain comprises means for computing a factor λ using the following relation:

$$\lambda=0.5(1-rv).$$

29. A gain-smoothed codevector producing device as claimed in claim 28, wherein a factor, λ=0 indicates a pure voiced signal and a factor λ=1 indicates a pure unvoiced signal.

30. A gain-smoothed codevector producing device as claimed in claim 21, wherein the means for calculating a second factor comprises means for determining a distance measure giving a similarity between adjacent, successive linear prediction filters computed during encoding of the wideband signal.

31. A gain-smoothed codevector producing device as claimed in claim 30, wherein:

the wideband signal is sampled prior to encoding, and is processed by frames during encoding and decoding; and the means for determining a distance measure comprises means for calculating an Imimitance Spectral Pair distance measure between the Immitance Spectral Pairs in a present frame n of the wideband signal and the Immitance Spectral Pairs of a past frame n−1 of the wideband signal through the following relation:

$$D_s = \sum_{i=1}^{p-1} (isp_i^{(n)} - ispSUBt^{(n-1)})^2$$

where p is the order of the linear prediction filters.

32. A gain-smoothed codevector producing device as claimed in claim 31, wherein the means for calculating a second factor comprises means for mapping the Immitance Spectral Pair distance measure $D_s$ to said second factor θ through the following relation:

$$\theta=1.25-D_s/400000.0$$

bounded by $0 \leqq \theta \leqq 1$.

33. A gain-smoothed codevector producing device as claimed in claim 21, wherein the means for calculating a smoothing gain comprises means for calculating a gain smoothing factor Sm based on both the first λ and second θ factors through the following relation:

$$S_m=\lambda\theta.$$

34. A gain-smoothed codevector producing device as claimed in claim 33, wherein the factor $S_m$ has a value approaching 1 for an unvoiced and stable wideband signal, and a value approaching 0 for a pure voiced wideband signal or an unstable wideband signal.

35. A gain-smoothed codevector producing device as claimed in claim 21, wherein:

the means for finding a codevector comprises means for finding an innovative codevector in an innovative codebook in relation to said at least one first wideband signal encoding parameter;

the wideband signal is sampled prior to encoding, and is processed by frames and subframes during encoding and decoding; and the means for calculating a smoothing gain comprises means for computing an initial modified gain g0, said initial modified gain computing means comprising means for comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g ≦ g − 1 |
| and | | |
| if g ≧ g − 1 then | g0 = g/1.19 | bounded by g0 ≧ g − 1. |

36. A gain-smoothed codevector producing method as claimed in claim 35, wherein the means for calculating a smoothing gain comprises means for calculating a gain smoothing factor $S_m$ based on both the first λ and second θ factors through the following relation:

$$S_m=\lambda\theta, \text{ and}$$

means for determining said smoothing gain through the following relation:

$$g_s=S_m*g_0+(1-S_m)*g.$$

37. A cellular communication system for servicing a large geographical area divided into a plurality of cells, comprising:

mobile transmitter/receiver units;

cellular base stations respectively situated in said cells;

means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including a decoder for encoding a wideband signal and means for transmitting the encoded wideband signal, and (b) a receiver including means for receiving a transmitted encoded wideband signal and a decoder for decoding the received encoded wideband signal;

wherein said decoder comprises means responsive to a set of wideband signal encoding parameters for decoding the received encoded wideband signal, and wherein said wideband signal decoding means comprises a device as recited in claim 21, for producing a gain-smoothed codevector during decoding of the encoded wideband signal from said set of wideband signal encoding parameters.

38. The cellular communication system of claim 37, wherein:

the means for finding a codevector comprises means for finding an innovative codevector in an innovative codebook in relation to said at least one first wideband signal encoding parameter; and the smoothing gain calculating means comprises means for calculating the smoothing gain also in relation to an innovative codebook gain forming a fourth wideband signal encoding parameter of said set.

39. The cellular communication system of claim 37, wherein:

the means for finding a codevector comprises means for finding a codevector in a codebook in relation to said at least one first wideband signal encoding parameter; and said at least one first wideband signal encoding parameter comprises an innovative codebook index.

40. The cellular communication system of claim 37, wherein:

the means for finding a codevector comprises means for finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

41. The cellular communication system of claim 37, wherein said at least one third wideband signal encoding parameter comprises coefficients of a linear prediction filter calculated during encoding of the wideband signal.

42. The cellular communication system of claim 37, wherein:

the means for finding a codevector comprises means for finding an innovative codevector in an innovative codebook in relation to an index k of said innovative codebook, said index k forming said at least one first wideband signal encoding parameter; and the means for calculating a first factor comprises means for computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

43. The cellular communication system of claim 42, wherein the voicing factor rv has a value located between −1 and 1, wherein value 1 corresponds to a pure voiced signal and value −1 corresponds to a pure unvoiced signals.

44. The cellular communication system of claim 43, wherein the means for calculating a smoothing gain comprises means for computing a factor λ using the following relation:

$$\lambda=0.5(1-rv).$$

45. The cellular communication system of claim 44, wherein a factor λ=0 indicates a pure voiced signal and a factor λ=1 indicates a pure unvoiced signal.

46. The cellular communication system of claim 37, wherein the means for calculating a second factor comprises means for determining a distance measure giving a similarity between adjacent, successive linear prediction filters computed during encoding of the wideband signal.

47. The cellular communication system of claim 46, wherein:

the wideband signal is sampled prior to encoding, and is processed by. frames during encoding and decoding; and the means for determining a distance measure comprises means for calculating an Immitance Spectral Pair distance measure between the Immitance Spectral Pairs in a present frame n of the wideband signal and the Immitance Spectral Pairs of a past frame n−1 of the wideband signal through the following relation:

$$D_s=\sum_{i=1}^{p-1}(isp_i^{(n)}-ispSUBl^{(n-1)})^2$$

where p is the order of the linear prediction filters.

48. The cellular Communication system of claim 47, wherein the means for calculating a second factor comprises means for mapping the Immitance Spectral Pair distance measure $D_s$ to said second factor θ through the following relation:

$$\theta=1.25-D_s/400000.0$$

bounded by $0\leqq\theta\leqq1$.

49. The cellular communication system of claim 37, wherein the means for calculating a smoothing gain comprises means for calculating a gain smoothing factor $S_m$ based on both the first λ and second θ factors through the following relation:

$$S_m=\lambda\theta.$$

50. The cellular communication system of claim 49, wherein the factor $S_m$ has a value approaching 1 for an unvoiced and stable wideband signal, and a value approaching 0 for a pure voiced wideband signal or an unstable wideband signal.

51. The cellular communication system of claim 37, wherein:

the means for finding a codevector comprises means for finding an innovative codevector in an innovative codebook in relation to said at least one first wideband signal encoding parameter;

the wideband signal is sampled prior to encoding, and is processed by frames and subframes during encoding and decoding; and the means for calculating a smoothing gain comprises means for computing an initial modified gain g0, said initial modified gain computing means comprising means for comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g0 ≦ g − 1 |
| and | | |
| if g ≧ g − 1 then | g0 = g/1.19 | bounded by g0 ≧ g − 1. |

52. The cellular communication system of claim 51, wherein the means for calculating a smoothing gain comprises means for calculating a gain smoothing factor $S_m$ based on both the first λ and second θ factors through the following relation:

$$S_m=\lambda\theta, \text{ and}$$

means for determining said smoothing gain through the following relation:

$$g_s=S_m*g_0+(1-S_m)*g.$$

53. A cellular network element comprising (a) a transmitter including an encoder for encoding a wideband signal and means for transmitting the encoded wideband signal, and (b) a receiver including means for receiving a transmitted encoded wideband signal and a decoder for decoding the received encoded wideband signal;

wherein said decoder comprises means responsive to a set of wideband signal encoding parameters for decoding the received encoded wideband signal, and wherein said wideband signal decoding means comprises a device as recited in claim 21, for producing a gain-smoothed codevector during decoding of the encoded wideband signal from said set of wideband signal encoding parameters.

54. A cellular network element as claimed in claim 53, wherein:

the means for finding a codevector comprises means for finding an innovative codevector in an innovative codebook in relation to said at least one first wideband signal encoding parameter; and the smoothing gain calculating means comprises means for calculating the smoothing gain also in relation to an innovative codebook gain forming a fourth wideband signal encoding parameter of said set.

55. A cellular network element as claimed in claim 53, wherein:

the means for finding a codevector comprises means for finding a codevector in a codebook in relation to said at least one first wideband signal encoding parameter; and said at least one first wideband signal encoding parameter comprises an innovative codebook index.

56. A cellular network element as claimed in claim 53, wherein:

the means for finding a codevector comprises means for finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

57. A cellular network element as claimed in claim 53, wherein said at least one third wideband signal encoding parameter comprises coefficients of a linear prediction filter calculated during encoding of the wideband signal.

58. A cellular network element as claimed in claim 53, wherein:

the means for finding a codevector comprises means for finding an innovative codevector in an innovative codebook in relation to an index k of said innovative codebook, said index k forming said at least one first wideband signal encoding parameter; and the means for calculating a first factor comprises means for computing a voicing factor rv by means of the following relation:

$$rv(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

59. A cellular network element as claimed in claim 58, wherein the voicing factor rv has a value located between −1 and 1, wherein value 1 corresponds to a pure voiced signal and value −1 corresponds to a pure unvoiced signals.

60. A cellular network element as claimed in claim 59, wherein the means for calculating a smoothing gain comprises means for computing a factor λ using the following relation:

$$\lambda=0.5(1-rv).$$

61. A cellular network element as claimed in claim 60, wherein a factor λ=0 indicates a pure voiced signal and a factor λ=1 indicates a pure unvoiced signal.

62. A cellular network element as claimed in claim 53, wherein the means for calculating a second factor comprises means for determining a distance measure giving a similarity between adjacent, successive linear prediction filters computed during encoding of the wideband signal.

63. A cellular network element as claimed in claim 62, wherein:

the wideband signal is sampled prior to encoding, and is processed by frames during encoding and decoding; and the means for determining a distance measure comprises means for calculating an Immitance Spectral Pair distance measure between the Immitance Spectral Pairs in a present frame n of the wideband signal and the Immitance Spectral Pairs of a past frame n−1 of the wideband signal through the following relation:

$$D_s = \sum_{i=1}^{p-1} (isp_i^{(n)} - ispSUBt^{(n-1)})^2$$

where p is the order of the linear prediction filters.

64. A cellular network element as claimed in claim 63, wherein the means for calculating a second factor comprises means for mapping the Immitance Spectral Pair distance measure $D_s$ to said second factor θ through the following relation:

$$\theta=1.25-D_s/400000.0$$

bounded by $0 \leqq \theta \leqq 1$.

65. A cellular network element as claimed in claim 53, wherein the means for calculating a smoothing gain comprises means for calculating a gain smoothing factor $S_m$ based on both the first λ and second θ factors through the following relation:

$$S_m=\lambda\theta.$$

66. A cellular network element as claimed in claim 65, wherein the factor $S_m$ has a value approaching 1 for an unvoiced and stable wideband signal, and a value approaching 0 for a pure voiced wideband signal or an unstable wideband signal.

67. A cellular network element as claimed in claim 53, wherein:

the means for finding a codevector comprises means for finding an innovative codevector in an innovative codebook in relation to said at least one first wideband signal encoding parameter;

the wideband signal is sampled prior to encoding, and is processed by frames and subframes during encoding and decoding; and the means for calculating a smoothing gain comprises means for computing an initial modified gain g0, said initial modified gain computing means comprising means for comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g0 ≦ g − 1 |
| and | | |
| if g ≧ g − 1 then | g0 = g/1.19 | bounded by g0 ≧ g − 1. |

68. A cellular network element as claimed in claim 67, wherein the means for calculating a smoothing gain comprises means for calculating a gain smoothing factor $S_m$ based on both the first λ and second θ factors through the following relation:

$$S_m=\lambda\theta, \text{ and}$$

means for determining said smoothing gain through the following relation:

$$g_s=S_m*g_0+(1-S_m)*g.$$

69. A cellular mobile transmitter/receiver unit comprising (a) a transmitter including an encoder for encoding a wideband signal and means for transmitting the encoded wideband signal, and (b) a receiver including means for receiving a transmitted encoded wideband signal and a decoder for decoding the received encoded wideband signal;

wherein said decoder comprises means responsive to a set of wideband signal encoding parameters for decoding the received encoded wideband signal, and wherein said wideband signal decoding means comprises a device as recited in claim 21, for producing a gain smoothed codevector during decoding of the encoded wideband signal from said set of wideband signal encoding parameters.

70. A cellular mobile transmitter/receiver unit as claimed in claim 69, wherein:

the means for finding a codevector comprises means for finding an innovative codevector in an innovative codebook in relation to said at least one first wideband signal encoding parameter; and the smoothing gain calculating means comprises means for calculating the smoothing gain also in relation to an innovative codebook gain forming a fourth wideband signal encoding parameter of said set.

71. A cellular mobile transmitter/receiver unit as claimed in claim 69, wherein:

the means for finding a codevector comprises means for finding a codevector in a codebook in relation to said at least one first wideband signal encoding parameter; and said at least one first wideband signal encoding parameter comprises an innovative codebook index.

72. A cellular mobile transmitter/receiver unit as claimed in claim 69, wherein:

the means for finding a codevector comprises means for finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

73. A cellular mobile transmitter/receiver unit as claimed in claim 69, wherein said at least one third wideband signal encoding parameter comprises coefficients of a linear prediction filter calculated during encoding of the wideband signal.

74. A cellular mobile transmitter/receiver unit as claimed in claim 69, wherein:

the means for finding a codevector comprises means for finding an innovative codevector in an innovative codebook in relation to an index k of said innovative codebook, said index k forming said at least one first wideband signal encoding parameter; and the means for calculating a first factor comprises means for computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

75. A cellular mobile transmitter/receiver unit as claimed in claim 74, wherein the voicing factor rv has a value located between −1 and 1, wherein value 1 corresponds to a pure voiced signal and value −1 corresponds to a pure unvoiced signals.

76. A cellular mobile transmitter/receiver unit as claimed in claim 75, wherein the means for calculating a smoothing gain comprises means for computing a factor λ using the following relation:

$$\lambda=0.5(1-rv).$$

77. A cellular mobile transmitter/receiver unit as claimed in claim 76, wherein a factor λ=0 indicates a pure voiced signal and a factor λ=1 indicates a pure unvoiced signal.

78. A cellular mobile transmitter/receiver unit as claimed in claim 69, wherein the means for calculating a second factor comprises means for determining a distance measure giving a similarity between adjacent, successive linear prediction filters computed during encoding of the wideband signal.

79. A cellular mobile transmitter/receiver unit as claimed in claim 78, wherein:

the wideband signal is sampled prior to encoding, and is processed by frames during encoding and decoding; and the means for determining a distance measure comprises means for calculating an Immitance Spectral Pair distance measure between the Immitance Spectral Pairs in a present frame n of the wideband signal and the Immitance Spectral Pairs of a past frame n−1 of the wideband signal through the following relation:

$$D_s=\sum_{i=1}^{p-1}(isp_i^{(n)}-ispSUBt^{(n-1)})^2$$

where p is the order of the linear prediction filters.

80. A cellular mobile transmitter/receiver unit as claimed in claim 79, wherein the means for calculating a second factor comprises means for mapping the Immitance Spectral Pair distance measure Ds to said second factor θ through the following relation:

$$\theta=1.25-D_s/400000.0$$

bounded by $0 \leqq \theta \leqq 1$.

81. A cellular mobile transmitter/receiver unit as claimed in claim 69, wherein the means for calculating a smoothing gain comprises means for calculating a gain smoothing factor $S_m$ based on both the first λ and second θ factors through the following relation:

$$S_m=\lambda\theta.$$

82. A cellular mobile transmitter/receiver unit as claimed in claim 81, wherein the factor $S_m$ has a value approaching 1 for an unvoiced and stable wideband signal, and a value approaching 0 for a pure voiced wideband signal or an unstable wideband signal.

83. A cellular mobile transmitter/receiver unit as claimed in claim 69, wherein:

the means for finding a codevector comprises means for finding an innovative codevector in an innovative codebook in relation to said at least one first wideband signal encoding parameter;

the wideband signal is sampled prior to encoding, and is processed by frames and subframes during encoding and decoding; and the means for calculating a smoothing gain comprises means for computing an initial modified gain g0, said initial modified gain computing means comprising means for comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g0 ≦ g − 1 |
| and | | |
| if g ≧ g − 1 then | g0 = g/1.19 | bounded by g0 ≧ g − 1. |

84. A cellular mobile transmitter/receiver unit as claimed in claim 83, wherein the means for calculating a smoothing gain comprises means for calculating a gain smoothing factor Sm based on both the first λ and second θ factors through the following relation:

$$S_m=\lambda\theta, \text{ and}$$

means for determining said smoothing gain through the following relation:

$$g_s=S_m*g_0+(1-S_m)*g.$$

85. In a cellular communication system for servicing a large geographical area divided into a plurality of cells, comprising: mobile transmitter/receiver units; cellular base stations respectively situated in said cells; and means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including an encoder for encoding a wideband signal and means for transmitting the encoded wideband signal, and (b) a receiver including means for receiving a transmitted encoded wideband signal and a decoder for decoding the received encoded wideband signal;

wherein said decoder comprises means responsive to a set of wideband signal encoding parameters for decoding the received encoded wideband signal, and wherein said wideband signal decoding means comprises a device as recited in claim 21, for producing a gain-smoothed codevector during decoding of the encoded wideband signal from said set of wideband signal encoding parameters.

86. The bidirectional wireless communication sub-system of claim 85, wherein:

the means for finding a codevector comprises means for finding an innovative codevector in an innovative codebook in relation to said at least one first wideband signal encoding parameter; and the smoothing gain calculating means comprises means for calculating the smoothing gain also in relation to an innovative codebook gain forming a fourth wideband signal encoding parameter of said set.

87. A bidirectional wireless communication sub-system as claimed in claim 85, wherein:

the means for finding a codevector comprises means for finding a codevector in a codebook in relation to said at least one first wideband signal encoding parameter; and said at least one first wideband signal encoding parameter comprises an innovative codebook index.

88. A bidirectional wireless communication sub-system as claimed in claim 85, wherein:

the means for finding a codevector comprises means for finding an innovative codevector in an innovative codebook in relation to said at least one first wideband signal encoding parameter; and said at least one second wideband signal encoding parameter comprises the following parameters:

a pitch gain computed during encoding of the wideband signal;

a pitch delay computed during encoding of the wideband signal;

an index j of a low-pass filter selected during encoding of the wideband signal and applied to a pitch codevector computed during encoding of the wideband signal; and an innovative codebook index computed during encoding of the wideband signal.

89. A bidirectional wireless communication sub-system as claimed in claim 85, wherein said at least one third wideband signal encoding parameter comprises coefficients of a linear prediction filter calculated during encoding of the wideband signal.

90. A bidirectional wireless communication sub-system as claimed in claim 85, wherein:

the means for finding a codevector comprises means for finding an innovative codevector in an innovative codebook in relation to an index k of said innovative codebook, said index k forming said at least one first wideband signal encoding parameter; and the means for calculating a first factor comprises means for computing a voicing factor rv by means of the following relation:

$$rv=(Ev-Ec)/(Ev+Ec)$$

where:

Ev is the energy of a scaled adaptive codevector bvT;

Ec is the energy of a scaled innovative codevector gck;

b is a pitch gain computed during encoding of the wideband signal;

T is a pitch delay computed during encoding of the wideband signal;

vT is an adaptive codebook vector at pitch delay T;

g is an innovative codebook gain computed during encoding of the wideband signal;

k is an index of the innovative codebook computed during encoding of the wideband signal; and ck is the innovative codevector of said innovative codebook at index k.

91. A bidirectional wireless communication sub-system as claimed in claim 90, wherein the voicing factor rv has a value located between −1 and 1, wherein value 1 corresponds to a pure voiced signal and value −1 corresponds to a pure unvoiced signals.

92. A bidirectional wireless communication sub-system as claimed in claim 91, wherein the means for calculating a smoothing gain comprises means for computing a factor λ using the following relation:

$$\lambda=0.5(1-rv).$$

93. A bidirectional wireless communication sub-system as claimed in claim 92, wherein a factor λ=0 indicates a pure voiced signal and a factor λ=1 indicates a pure unvoiced signal.

94. A bidirectional wireless communication sub-system as claimed in claim 85, wherein the means for calculating a second factor comprises means for determining a distance measure giving a similarity between adjacent, successive linear prediction filters computed during encoding of the wideband signal.

95. A bidirectional wireless communication sub-system as claimed in claim 94, wherein:

the wideband signal is sampled prior to encoding, and is processed by frames during encoding and decoding; and the means for determining a distance measure comprises means for calculating an Immitance Spectral Pair distance measure between the Immitance Spectral Pairs in a present frame n of the wideband signal and the Immitance Spectral Pairs of a past frame n−1 of the wideband signal through the following relation:

$$D_s = \sum_{i=1}^{p-1} (isp_i^{(n)} - ispSUBt^{(n-1)})^2$$

where p is the order of the linear prediction filters.

96. A bidirectional wireless communication sub-system as claimed in claim 95, wherein the means for calculating a second factor comprises means for mapping the Immitance Spectral Pair distance measure Ds to said second factor θ through the following relation:

$$\theta=1.25-D_s/400000.0$$

bounded by $0 \leqq \theta \leqq 1$.

97. A bidirectional wireless communication sub-system as claimed in claim 85, wherein the means for calculating a smoothing gain comprises means for calculating a gain smoothing factor $S_m$ based on both the first λ and second θ factors through the following relation:

$$S_m=\lambda\theta.$$

98. A bidirectional wireless communication sub-system as claimed in claim 97, wherein the factor Sm has a value approaching 1 for an unvoiced and stable wideband signal, and a value approaching 0 for a pure voiced wideband signal or an unstable wideband signal.

99. A bidirectional wireless communication sub-system as claimed in claim 85, wherein:

the means for finding a codevector comprises means for finding an innovative codevector in an innovative codebook in relation to said at least one first wideband signal encoding parameter;

the wideband signal is sampled prior to encoding, and is processed by frames and subframes during encoding and decoding; and the means for calculating a smoothing gain comprises means for computing an initial modified gain g0, said initial modified gain computing means comprising means for comparing an innovative codebook gain g computed during encoding of the wideband signal to a threshold given by the initial modified gain from the past subframe g−1 as follows:

| | | |
|---|---|---|
| if g < g − 1 then | g0 = g × 1.19 | bounded by g ≦ g − 1 |
| and | | |
| if g ≧ g − 1 then | g0 = g/1.19 | bounded by g0 ≧ g − 1. |

100. A bidirectional wireless communication sub-system as claimed in claim 99, wherein the means for calculating a smoothing gain comprises means for calculating a gain smoothing factor Sm based on both the first λ and second θ factors through the following relation:

$$S_m=\lambda\theta, \text{ and}$$

means for determining said smoothing gain through the following relation:

$$g_s=S_m*g_0+(1-S_m)*g.$$

101. A device for producing a gain-smoothed codevector during decoding of an encoded signal from a set of signal encoding parameters, said signal containing stationary background noise and said device comprising:

means for finding a codevector in relation to at least one first signal encoding parameter of said set;

means for calculating at least one factor representative of stationary background noise in the signal in response to at least one second wideband signal encoding parameter of said set;

means for calculating a smoothing gain using a non linear operation based on said noise representative factor; and means for amplifying the found codevector with said smoothing gain to thereby produce said gain-smoothed codevector.

102. A device for producing a gain-smoothed codevector during decoding of an encoded wideband signal from a set of wideband signal encoding parameters, said device comprising:

means for finding a codevector in relation to at least one first wideband signal encoding parameter of said set;

means for calculating a factor representative of voicing in the wideband signal in response to at least one second wideband signal encoding parameter of said set;

means for calculating a smoothing gain using a non linear operation based on said voicing representative factor; and means for amplifying the found codevector with said smoothing gain to thereby produce said gain-smoothed codevector.

103. A device for producing a gain-smoothed codevector during decoding of an encoded wideband signal from a set of wideband signal encoding parameters, said device comprising:

means for finding a codevector in relation to at least one first wideband signal encoding parameter of said set;

means for calculating a factor representative of stability of said wideband signal in response to at least one second wideband signal encoding parameter of said set;

means for calculating a smoothing gain using a non linear operation based on said stability representative factor; and means for amplifying the found codevector with said smoothing gain to thereby produce said gain-smoothed codevector.

* * * * *